US008723781B2

(12) United States Patent
Fukutome et al.

(10) Patent No.: US 8,723,781 B2
(45) Date of Patent: May 13, 2014

(54) LIQUID CRYSTAL DISPLAY DEVICE

(75) Inventors: Takahiro Fukutome, Tochigi (JP); Takeshi Nishi, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 678 days.

(21) Appl. No.: 12/269,281

(22) Filed: Nov. 12, 2008

(65) Prior Publication Data

US 2009/0121987 A1 May 14, 2009

(30) Foreign Application Priority Data

Nov. 14, 2007 (JP) ..... 2007-295011

(51) Int. Cl.
*G09G 3/36* (2006.01)

(52) U.S. Cl.
USPC ..... 345/102; 345/76; 345/77; 345/82; 345/89; 345/90; 345/92; 345/690; 345/207; 349/61; 349/69; 362/97.3

(58) Field of Classification Search
USPC ..... 345/153, 163, 82, 87–104, 204, 76–77, 345/690, 207; 349/61, 69; 362/97.1–97.3
See application file for complete search history.

(56) References Cited

U.S. PATENT DOCUMENTS 5,892,494 A * 4/1999 Kimura et al. ..... 345/96
6,144,925 A * 11/2000 Hofstetter ..... 702/72
7,129,918 B2 10/2006 Kimura
7,187,355 B2 * 3/2007 Tam et al. ..... 345/98
7,289,098 B2 * 10/2007 Ahn ..... 345/102
2002/0122020 A1 * 9/2002 Moon et al. ..... 345/89
2004/0268072 A1 * 12/2004 Torii ..... 711/163
2005/0156831 A1 * 7/2005 Yamazaki et al. ..... 345/76
2007/0057887 A1 * 3/2007 Itakura et al. ..... 345/90
2007/0115223 A1 5/2007 Kimura
2007/0222743 A1 * 9/2007 Hirakata ..... 345/102
2007/0242031 A1 * 10/2007 Kimura et al. ..... 345/102

(Continued)

FOREIGN PATENT DOCUMENTS

JP 06-004047 1/1994
JP 11-202286 7/1999
JP 2000-056738 2/2000
JP 2005-345552 12/2005

OTHER PUBLICATIONS

International Search Report (Application No. PCT/JP2008/070249) Dated Feb. 24, 2009.

(Continued)

*Primary Examiner* — Lun-Yi Lao
*Assistant Examiner* — Saiful A Siddiqui
(74) *Attorney, Agent, or Firm* — Eric J. Robinson; Robinson Intellectual Property Law Office, P.C.

(57) ABSTRACT

A liquid crystal display device is provided, which includes a liquid crystal element including a pixel electrode, a counter electrode, and a liquid crystal disposed between the pixel electrode and the counter electrode, a light source, a comparing circuit configured to compare a potential of the pixel electrode and a reference potential, and supply an output potential in accordance with the result of the comparison, and a control circuit configured to switch turning-on and turning-off of the light source in accordance with the output potential supplied from the comparing circuit.

20 Claims, 18 Drawing Sheets

(56) References Cited

U.S. PATENT DOCUMENTS

| | | | | |
|---|---|---|---|---|
| 2007/0279359 | A1 | 12/2007 | Yoshida et al. | |
| 2008/0180385 | A1 | 7/2008 | Yoshida et al. | |
| 2008/0284720 | A1 | 11/2008 | Fukutome | |
| 2009/0121641 | A1* | 5/2009 | Shih | 315/157 |

OTHER PUBLICATIONS

Written Opinion (Application No. PCT/JP2008/070249) Dated Feb. 24, 2009.

* cited by examiner

LIQUID CRYSTAL DISPLAY DEVICE

TECHNICAL FIELD

This invention relates to a liquid crystal display device using a liquid crystal element.

BACKGROUND ART

Liquid crystal display devices display images by using a phenomenon in which the refractive index of liquid crystals is changed in accordance with a change in alignment of liquid crystal molecules when an electric field is applied to the liquid crystals, that is, an electro-optic effect of liquid crystals. In addition, the change in alignment of liquid crystal molecules follows a change in the voltage of an electric signal (a video signal) based on image information.

A response time, from when an applied voltage is changed to when a change in alignment of liquid crystal molecules converges, of liquid crystals used for a liquid crystal display device is approximately ten and several milliseconds in general, whereas, for example, one frame period is approximately 17 msec when a liquid crystal display device is driven at a frame frequency of 60 Hz. Thus, since a percentage of the response time of liquid crystals in one frame period is high, a change in the transmittance of a liquid crystal element is likely to appear a blur of a moving image. In order to improve image quality of an moving image, a response time can be shortened to some level by employing overdrive that changes alignment of liquid crystals quickly by setting a voltage applied to a liquid crystal element to be high level temporally, or by devising a countermeasure such as improving liquid crystals themselves. However, even if the response time is shortened, it takes approximately several milliseconds and image quality of a moving image still has a lot to be improved.

There is another reason why a moving image of a liquid crystal display device appears blurred, in addition to the above-described response time of liquid crystals, that is, the liquid crystal display device employs hold-driving in which a voltage is always applied to a liquid crystal element. Since human eyes have a property of recognizing afterimages, when any gray levels except black is consequently displayed, the human eyes cannot follow changes in the gray levels with hold-driving, whereby a moving image is likely to be seen as a blur.

Then, in order to solve blurs caused by both the response time of liquid crystals and hold-driving, impulsive driving has been proposed in which a backlight is turned off to display black during a period when a change in alignment of liquid crystal molecules is considerable. By employing impulsive driving, a backlight can be turned off during a period when a change in the transmittance of a liquid crystal element is considerable and afterimages can be prevented from being left in human eyes, whereby a blur of a moving image can be solved.

Reference 1 (Japanese Published Patent Application No. H11-202286) discloses a driving method in which traces in displaying moving images are eliminated by turning on a light when liquid crystals response after data is written to a pixel.

DISCLOSURE OF INVENTION

In the meantime, a response time of liquid crystals changes in accordance with the temperature of the liquid crystals. In general, although it depends on a material of the liquid crystals, the response time is short when the temperature is high, and the response time is long when the temperature is low. In addition, since the temperature of liquid crystals is largely changed due to the temperature of an environment where a liquid crystal display device is placed, self-heating of a semiconductor element, heat generation of a backlight, or the like, the response time of the liquid crystals is also changed considerably.

For example, the case of normally white TN liquid crystals manufactured by Merck Ltd., Japan (a trade name: ZLI4792) will be described. The normally white TN liquid crystals are in a light state with a high light-transmitting property when a voltage is not applied to the liquid crystals, and turn to a dark state with a low light-transmitting property from a light state with a high light-transmitting property when a voltage is applied to the liquid crystals. On the contrary, the normally white TN liquid crystals are in a dark state with a low light-transmitting property when a voltage is kept applied to the liquid crystals, and turn to a light state with a high light-transmitting property when application of the voltage to the liquid crystals is stopped. Focusing on a response time $\tau on$ liquid crystals take to turn from a light state to a dark state, in the case where a voltage applied to the liquid crystals is 5 V, when the temperature of the liquid crystals changes from 10° C. to 30° C., the response time $\tau on$ changes from 9.9 msec to 5.1 msec. Moreover, focusing on a response time $\tau off$ liquid crystals take to turn from a dark state to a light state, in the case where a voltage applied to the liquid crystals is 5 V, when the temperature of the liquid crystals changes from 10° C. to 30° C., the response time $\tau off$ changes from 23.4 msec to 11.9 msec.

On the other hand, conditions such as voltage and frequency of a video signal are set in accordance with the viscosity of liquid crystals at room temperature. However, while the viscosity of liquid crystals is changed in accordance with temperature, a change in the viscosity of liquid crystals is not reflected to a video signal. In other words, in an environment at a temperature lower than room temperature, the viscosity of liquid crystals becomes higher and the response speed of the liquid crystals becomes lower with that; however, conditions of a video signal, which are corresponding to the viscosity of the liquid crystals at room temperature are kept fixed. Therefore, in an environment at lower temperatures, a change in alignment of liquid crystal molecules follows a change in a voltage of a video signal with a further delay due to a decrease in the response speed of liquid crystals, whereby deterioration in display quality, such as display of a blurred moving image, becomes obvious.

Moreover, in the above-described impulsive driving, timing when a voltage is applied to a liquid crystal element and timing when a backlight is driven are set so as to turn off the backlight during a period when a change in alignment of liquid crystal molecules is considerable and to turn on the backlight during a period when a change in alignment of the liquid crystal molecules converges. However, as the response time of liquid crystals becomes longer due to a temperature change, a period when alignment of liquid crystal molecules considerably changes becomes longer, and the timing when a voltage is applied to a liquid crystal element and the timing when a backlight is driven are kept fixed as they are set even if the period when a change in alignment of the liquid crystal molecules converges is shortened. Therefore, a situation in which a backlight is turned on during a period when a change in alignment of liquid crystal molecules is considerable is likely to occur. As a result, the change in alignment of liquid crystal molecules, that is, a change in the transmittance of a liquid crystal element is seen and a moving image is likely to appear blurred.

In view of the above-described problem, an object of this invention is to provide a liquid crystal display device in which a moving image can be prevented from appearing blurred without being influenced by the temperature of liquid crystals.

The present inventors focus on a change in the relative permittivity of liquid crystals due to application of an electric field, and consider that a blur of a moving image may be prevented without being influenced by the temperature of the liquid crystals by making the change in the relative permittivity feedback to a light source (a backlight).

The form of liquid crystal molecules used for a liquid crystal display devices is generally stick. In addition, in liquid crystal molecules with a stick form, there is a difference in poralizability between a long axis direction and a short axis direction. Therefore, the refractive index of liquid crystals is changed in accordance with a change in alignment of the liquid crystal molecules. Relative permittivity also has anisotropy for a similar reason and the relative permittivity of liquid crystals depends on an alignment sate of the liquid crystal molecules. In addition, the relative permittivity of liquid crystals depends on an applied voltage.

Therefore, in this invention, by using a relation between relative permittivity and an alignment state, and a relation between relative permittivity and an applied voltage, and monitoring the voltage, the alignment state of liquid crystal molecules is indirectly figured out. Then, timing when a change in alignment of the liquid crystal molecules converges is found to set timing when a light source is driven is set as appropriate in accordance with the timing when the change in alignment of the liquid crystal molecules converges, so as to turn off the light source during a period when the change in alignment of the liquid crystal molecules is considerable and to turn on the light source during a period when the change in alignment of the liquid crystal molecules converges.

Specifically, a liquid crystal display device of this invention includes a pixel provided with a liquid crystal element having a pixel electrode, a counter electrode, and a liquid crystal to which a voltage is applied by the pixel electrode and the counter electrode, a light source for irradiating the pixel with light, a comparing circuit for comparing a potential of the pixel electrode and a potential serving as a reference with each other so that a potential to be output is switched in accordance with which potential is higher, and a control circuit for switching turning-on and turning-off of the light source in accordance with timing when a potential output from the comparing circuit is switched.

Specifically, a liquid crystal display device of this invention includes a pixel provided with a liquid crystal element having a pixel electrode, a counter electrode, and a liquid crystal to which a voltage is applied by the pixel electrode and the counter electrode, a light source for irradiating the pixel with light, a comparing circuit for comparing a potential of the pixel electrode and a potential serving as a reference with each other so that a potential to be output is switched in accordance with which potential is higher, a memory circuit for holding a potential output from the comparing circuit, and a switching circuit for controlling electric power supply to the light source in accordance with timing when a potential held in the memory circuit is switched.

In addition to the above-described structure, the liquid crystal display device of this invention may further include one or both of a capacitor element connected to the liquid crystal element in parallel and a capacitor element connected to the liquid crystal element in series.

Further, the liquid crystal display device of this invention may include a light detector for detecting the luminance or intensity of light in an environment where the liquid crystal display device is set, and generating an electric signal (a first signal), a signal generating circuit for generating a signal (a second signal) for adjusting the luminance of the light source so that the luminance of the light source is made higher as the luminance of light in the environment where the liquid crystal display device is set becomes higher, or the luminance of the light source is made lower as the luminance of light in the environment where the liquid crystal display device is set becomes lower, with the use of the first signal, and a luminance control circuit for adjusting the luminance of the light source in accordance with the second signal.

Specifically, a liquid crystal display device of this invention includes a pixel portion having a first region, a second region, and a pixel provided with a liquid crystal element having a pixel electrode, a counter electrode, and a liquid crystal to which a voltage is applied by the pixel electrode and the counter electrode provided for each of the first region and the second region; a first light source for irradiating a pixel in the first region with light; a second light source for irradiating a pixel in the second region with light; a first comparing circuit for comparing a potential of the pixel electrode of the liquid crystal element in the pixel in the first region and a potential serving as a reference with each other so that a potential to be output is switched in accordance with which potential is higher; a second comparing circuit for comparing a potential of the pixel electrode of the liquid crystal element in the pixel in the second region and a potential serving as a reference are compared with each other so that a potential to be output is switched in accordance with which potential is higher; a control circuit for switching turning-on and turning-off of the first light source in accordance with timing when a potential output from the first comparing circuit is switched, and switching turning-on and turning-off of the second light source in accordance with timing when a potential output from the second comparing circuit is switched; an image processing filter for averaging gray levels included in a first video signal to be input to the liquid crystal element in the pixel in the first region, and averaging gray levels included in a second video signal to be input to the liquid crystal element in the pixel in the second region; a signal processing circuit for generating a signal which makes luminance of the first light source higher than that of the second light source when a gray level of the first video signal averaged is higher than that of the second video signal averaged, and makes the luminance of the first light source lower than that of the second light source when a gray level of the first video signal averaged is lower than a gray level of the second video signal averaged; and a luminance control circuit for adjusting the luminance of the first light source and the luminance of the second light source in accordance with the signal.

Since the liquid crystal display device of this invention can figure out timing when a change in alignment of liquid crystal molecules converges, timing when a light source is driven can be set as appropriate in accordance with the timing of convergence. Therefore, without depending on the temperature of liquid crystals, the light source is off during a period when the change in alignment of the liquid crystal molecules is considerable and is on during a period when the change in alignment of the liquid crystal molecules converges, so that moving images can be prevented from appearing blurred.

BEST MODE FOR CARRYING OUT THE INVENTION

Hereinafter, the embodiment modes of this invention will be described with reference to the drawings. However, this invention can be embodied in many different modes and it is easily understood by those skilled in the art that the mode and detail can be variously changed without departing from the scope and spirit of this invention. Therefore, this invention should not be interpreted as being limited to the description of embodiment modes.

Embodiment Mode 1

Figure 1A:
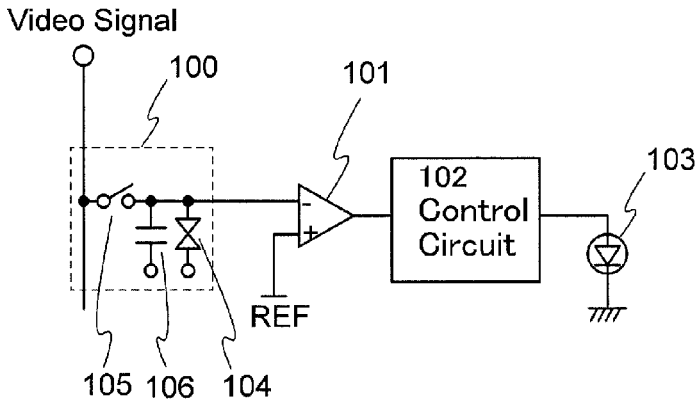
FIGS. 1A and 1B are diagrams each illustrating a structure of a liquid crystal display device according to an aspect of this invention.

In FIG. 1A, a structure of a liquid crystal display device of this invention is shown. The liquid crystal display device shown in FIG. 1A includes a pixel 100, a comparing circuit 101, a control circuit 102, and a light source 103. In addition, the pixel 100 includes at least a liquid crystal element 104, a switching element 105, and a capacitor element 106. The liquid crystal element 104 includes a pixel electrode, a counter electrode, and liquid crystals to which a voltage between the pixel electrode and the counter electrode is applied.

The light source 103 has a function of irradiating the pixel 100 with light.

The switching element 105 controls whether or not to apply a potential of a video signal to the pixel electrode of the liquid crystal element 104. A predetermined potential COM is applied to the counter electrode of the liquid crystal element 104. In addition, the capacitor element 106 includes a pair of electrodes; one electrode (first electrode) is connected to the pixel electrode of the liquid crystal element 104, and a predetermined potential GND is applied to the other electrode (second electrode). Note that the term "connection" in this specification includes both electrical connection and direct connection.

When the switching element 105 is turned on, a potential Vs of the video signal is applied to the pixel electrode of the liquid crystal element 104 and the first electrode of the capacitor element 106. Therefore, when the switching element 105 has just been turned on, a voltage $V_L$ between the pixel electrode and the counter electrode of the liquid crystal element 104 is equal to a difference between the potential Vs and the potential COM, and a voltage $V_{CS}$ between the first and second electrodes of the capacitor element 106 is equal to a difference between the potential Vs and the potential GND. Note that although the capacitor element 106 is not always necessary, a change in a potential of the pixel electrode due to leakage of charge from the switching element 105 can be prevented by providing the capacitor element 106.

Then, when a voltage is applied between the pixel electrode and the counter electrode, alignment of liquid crystal molecules in the liquid crystals included in the liquid crystal element 104 starts to change. Note that the relative permittivity of the liquid crystals is anisotropic, and that looking a liquid crystal molecules as an oval, the relative permittivity in the long axis direction and the relative permittivity in a direction perpendicular to the long axis direction, that is, the short axis direction are different. Accordingly, the relative permittivity of the liquid crystals changes in accordance with a change in alignment of the liquid crystal molecules. For example, in the case of TN liquid crystals (a trade name: MJ001393) manufactured by Merck Ltd., Japan, the relative permittivity of liquid crystal molecules in the long axis direction is 8.1 and the relative permittivity of the liquid crystal molecules in the short axis direction is 3.8; the relative permittivity is increased approximately 2.1-fold at a maximum due to a change in alignment of the liquid crystal molecules.

Figure 18A:
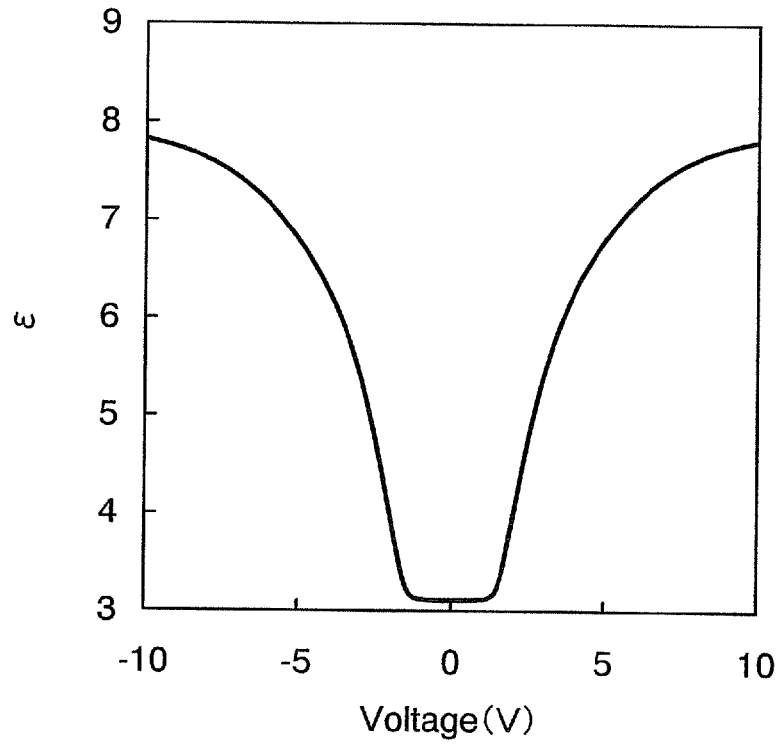
FIG. 18A is a graph illustrating a relationship between applied voltage and relative permittivity.
Figure 18B:
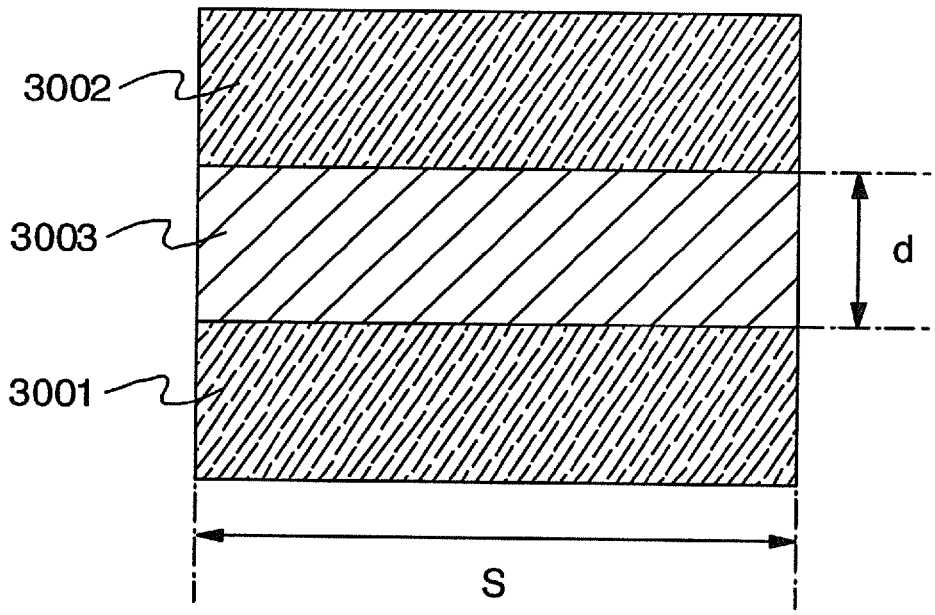
FIG. 18B is a cross-sectional schematic view of a liquid crystal element.

In FIG. 18A, a relation between a voltage (applied voltage) applied to the liquid crystal element and relative permittivity in the case where nematic liquid crystals are used is shown as an example. Note that as shown in a cross-sectional schematic view in FIG. 18B, FIG. 18A shows data in the case where the liquid crystal element includes a liquid crystal layer 3003 between a pixel electrode 3001 and a counter electrode 3002, and that liquid crystals (a trade name: ZLI4792) manufactured by Merck Ltd., Japan are used for the liquid crystal layer 3003, and a cell gap d is 3.7 μm. Moreover, alignment treatment is performed in advance so as to align the liquid crystal molecules in the liquid crystal layer 3003 in parallel with a surface of a pixel electrode 3001. From FIGS. 18A and 18B, it is found that the relative permittivity of the liquid crystals depends on the voltage applied to the liquid crystal element.

Noted that looking the liquid crystal element 104 as a capacitor, a capacitance value $C_L$ thereof can be represented by Formula 1 below. Note that $\in_0$ represents permittivity in a vacuum, $\in$ represents the relative permittivity of the liquid crystals, S represents the area of the liquid crystal element 104, and d represents a distance (cell gap) between the first and second electrodes of the liquid crystal element 104. Note that although the relative permittivity of an alignment film actually influences the capacitance value $C_L$, the relative permittivity of the alignment film is not considered in Formula 1 for convenience of explanation.

$$C_L=\in_0\in\times S/d \quad \text{(Formula 1)}$$

A relationship of the capacitance value $C_L$, a charge Q, and a voltage $V_L$ between the pixel electrode and the counter electrode of the liquid crystal element 104 can be represented by Formula 2 below.

$$Q=C_L\times V_L \quad \text{(Formula 2)}$$

Accordingly, Formula 3 below is found from Formulas 1 and 2.

$$V_L=d\times Q/(\in_0\in\times S) \quad \text{(Formula 3)}$$

In Formula 3, the distance d between the first and second electrodes, the area S of the liquid crystal element 104, and the permittivity $\in_0$ in a vacuum are fixed values. Supposing that the charge Q of the liquid crystal element 104 does not leak, which is an ideal state, the charge Q can be regarded as a fixed value. Accordingly, Formula 3 shows that the voltage $V_L$ between the pixel electrode and the counter electrode of the liquid crystal element 104 changes when the relative permittivity $\in$ of the liquid crystals changes due to a change in alignment of the liquid crystal molecules. Therefore, after the switching element 105 is turned on to apply the potential Vs of the video signal to the pixel electrode of the liquid crystal element 104, by tracing a change in the voltage $V_L$ when the switching element 105 is turned off, that is, a change in the potential of the pixel electrode included in the liquid crystal element 104, an alignment state of the liquid crystal molecules can be figured out, so that timing when a change in alignment of the liquid crystal molecules converges can be found out.

Note that in the case of FIG. 1A, since the liquid crystal element 104 and the capacitor element 106 are connected in series, the potential of the pixel electrode is determined in accordance with a ratio of the capacitance value of the liquid crystal element 104 to the capacitance value of the capacitor element 106. For example, a ratio of the capacitance value $C_L$ of the liquid crystal element 104 to the capacitance value Cs of the capacitor element 106 is assumed to be 100:100 before the voltage Vs of the video signal is applied. When the above-described TN liquid crystals (a trade name: MJ001393) manufactured by Merck Ltd., Japan are used for the liquid crystal element 104, the relative permittivity of the liquid crystal molecules ultimately increases approximately 2.1-fold at a maximum due to application of the voltage Vs of the video signal, whereby the capacitance value $C_L$ of the liquid crystal element 104 increases 2.1-fold. Therefore, when the change in alignment of the liquid crystal molecules converges after the application of the voltage Vs of the video signal, the ratio of the capacitance value $C_L$ of the liquid crystal element 104 to the capacitance value Cs of the capacitor element 106 is 210:100. Accordingly, when the change in alignment of the liquid crystal molecules converges, the potential of the pixel electrode also converges so as to make a ratio of the voltage $V_L$ between the pixel electrode and the counter electrode of the liquid crystal element 104 to the voltage $V_{CS}$ between the first and second electrodes of the capacitor element 106 to be 210:100.

The comparing circuit 101 compares a potential applied from the pixel 100 to the pixel electrode of the liquid crystal element 104 with a potential REF serving as a reference, and outputs one of binary potentials, which are different from each other, in accordance with a result of the comparison. For example, when the potential of the pixel electrode is higher than the potential REF, a potential OUT1 is output, and when the potential of the pixel electrode is equal to or lower than the potential REF, a potential OUT2 is output. By setting the potential REF to be the same as a potential of the pixel electrode, which may be obtained when the change in alignment of the liquid crystal molecules converges, a potential to be output from the comparing circuit 101 can be different between before and after the converge of the change in alignment of the liquid crystal molecules. Note that in actual driving of the liquid crystal display device, the charge Q of the liquid crystal element 104 leaks in some small measure. Therefore, the value of the potential REF is preferably set in consideration of amount of the change in the potential of the pixel electrode due to the leakage.

Note that although FIG. 1A illustrates an example of using an operational amplifier as the comparing circuit 101, not being limited to the operational amplifier, any circuit that can output one of binary potentials according to a result of comparing the potential applied from the pixel 100 with the potential REF which serves as a reference can be used as the comparing circuit 101.

The control circuit 102 controls driving of the light source 103 in accordance with a potential output from the comparing circuit 101. Specifically, when one of binary potentials is output from the comparing circuit 101, the light source 103 is turned on by the control of the control circuit 102, and when the other potential is output from the comparing circuit 101, the light source 103 is turned off by the control of the control circuit 102. Since the value of the potential output from the comparing circuit 101 is different between before and after the converge of the change in alignment of the liquid crystal molecules, the control circuit 102 can control the driving of the light source 103 in accordance with timing when alignment of the liquid crystal molecules is changed.

Thus, in this invention, since timing when a change in the alignment of the liquid crystal molecules converges can be figured out, timing when the light source 103 is driven can be newly set as appropriate in accordance with the timing of this convergence. Accordingly, even when the response speed of the liquid crystals changes, by turning off the light source 103 during a period when the change in alignment of the liquid crystal molecules is considerable, and by turning on the light source 103 during a period when the change in alignment of the liquid crystal molecules converges, moving images can be prevented from appearing blurred.

Note that although FIG. 1A illustrates an example in which the potential COM is applied to the counter electrode of the liquid crystal element 104 and the potential GND is applied to the second electrode of the capacitor element 106, the potential COM may be applied to both the counter electrode of the liquid crystal element 104 and the second electrode of the capacitor element 106. In that case, since the liquid crystal element 104 and the capacitor element 106 are connected in parallel, Formula 4 below is found out.

$$V_L=Q/(C_L+Cs) \quad \text{(Formula 4)}$$

In the case where the liquid crystal element 104 and the capacitor element 106 are connected in parallel, for example, a ratio of the capacitance value $C_L$ of the liquid crystal element 104 to the capacitance value Cs of the capacitor element 106 is assumed to be 100:100 before the voltage Vs of the video signal is applied. When the above-described TN liquid crystals (a trade name: MJ001393) manufactured by Merck Ltd., Japan are used for the liquid crystal element 104, the relative permittivity of the liquid crystal molecules ultimately increases approximately 2.1-fold at a maximum due to application of the voltage Vs of the video signal, whereby the capacitance value $C_L$ of the liquid crystal element 104 increases 2.1-fold. Therefore, when the change in alignment of the liquid crystal molecules converges after the application of the voltage Vs of the video signal, a ratio of the capacitance value $C_L$ of the liquid crystal element 104 to the capacitance value Cs of the capacitor element 106 is 210:100. Accordingly, the voltage $V_L$ between the pixel electrode and the counter electrode of the liquid crystal element 104 before alignment of the liquid crystal molecules starts to change is changed by 0.31 times after the change in alignment of the liquid crystal molecules converges.

The potential of the pixel electrode, which may be obtained when the change in alignment of the liquid crystal molecules converges, is changed in accordance with a connection relationship between the liquid crystal element 104 and the capacitor element 106. Therefore, the potential REF which serves as a reference may be set as appropriate in accordance with the structure of the pixel 100.

Figure 1B:
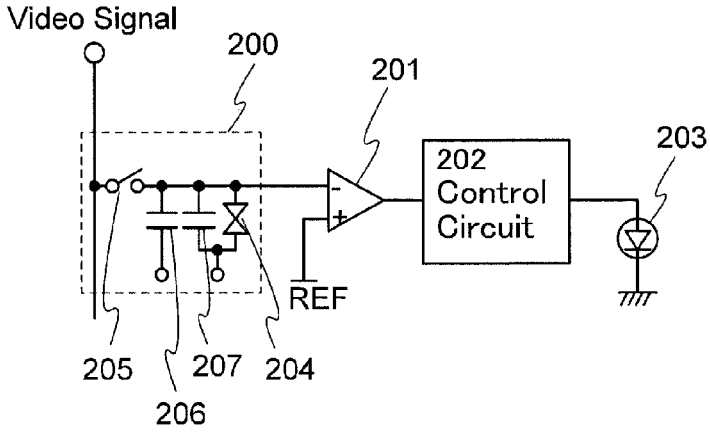

Next, FIG. 1B shows another structure of a liquid crystal display device of this invention, which is different from that shown in FIG. 1A. A liquid crystal display device shown in FIG. 1B includes a pixel 200, a comparing circuit 201, a control circuit 202, and a light source 203. The pixel 200 includes at least a liquid crystal element 204, a switching element 205, a capacitor element 206, and a capacitor element 207. The liquid crystal element 204 includes a pixel electrode, a counter electrode, and liquid crystals to which a voltage between the pixel electrode and the counter electrode is applied.

The switching element 205 controls whether or not to apply a potential of a video signal to the pixel electrode of the liquid crystal element 204. A predetermined potential COM is applied to the counter electrode of the liquid crystal element 204. In addition, the capacitor element 206 includes a pair of electrodes; one electrode (first electrode) is connected to the pixel electrode of the liquid crystal element 204, and a predetermined potential GND is applied to the other electrode (second electrode). Moreover, the capacitor element 207 includes a pair of electrodes; one electrode (first electrode) is connected to the pixel electrode of the liquid crystal element 204 and a predetermined potential COM is applied to the other electrode (second electrode). Therefore, in the liquid crystal display device shown in FIG. 1B, the liquid crystal element 204 and the capacitor element 206 are connected in series and the liquid crystal element 204 and the capacitor element 207 are connected in parallel.

When the switching element 205 is turned on, a potential Vs of the video signal is applied to the pixel electrode of the liquid crystal element 204, the first electrode of the capacitor element 206, and the first electrode of the capacitor element 207 through the switching element 205. Therefore, when the switching element 205 has just been turned on, a voltage $V_L$ between the pixel electrode and the counter electrode of the liquid crystal element 204 is equal to a difference between the potential Vs and the potential COM, a voltage $V_{CS1}$ between the first and second electrodes of the capacitor element 206 is equal to a difference between the potential Vs and the potential GND, and a voltage $V_{CS2}$ between the first and second electrodes of the capacitor element 207 is equal to a difference between the potential Vs and the potential COM.

Then, when a voltage is applied between the pixel electrode and the counter electrode, alignment of liquid crystal molecules in the liquid crystals included in the liquid crystal element 204 starts to change. Then, as described above, when the relative permittivity of the liquid crystals is changed due to a change in alignment of the liquid crystal molecules, the voltage $V_L$ between the pixel electrode and the counter electrode of the liquid crystal element 204 is changed. Accordingly, a change in the voltage $V_L$ after the potential Vs of the video signal is applied to the pixel electrode of the liquid crystal element 204 by turning on the switching element 205, and the switching element 205 is turned off, that is, a change in the potential of the pixel electrode included in the liquid crystal element 204 is traced, so that an alignment state of the liquid crystal molecules is figured out and timing when the change in alignment of the liquid crystal molecules converges can be found out.

Note that in the case of FIG. 1B, the liquid crystal element 204 and the capacitor element 206 are connected in series, and the liquid crystal element 204 and the capacitor element 207 are connected in parallel. Therefore, a potential of the pixel electrode is determined in accordance with the ratio of the capacitance value of the liquid crystal element 204 to that of the capacitor element 206 to that of the capacitor element 207.

The capacitance value of the capacitor element 106 shown in FIG. 1A is set to be large enough to prevent a change in the potential of the pixel electrode due to leakage of charge. However, if the capacitance value of the capacitor element 106 is too large compared to that of the liquid crystal element 104, even when the capacitance value of the liquid crystal element 104 is changed, a change in the potential of the pixel electrode of the liquid crystal element 104 becomes small, whereby an alignment state of the liquid crystal molecules becomes difficult to figure out. Therefore, in the case of the pixel 100 shown in FIG. 1A, in order to figure out an alignment state of the liquid crystal molecules more certainly by making a change in the potential of the pixel electrode of the liquid crystal element 104 considerable, the capacitance value of the capacitor element 106 and the capacitance value of the liquid crystal element 104 are set so as not to be too different from each other, or preferably, so as to be approximately the same.

On the other hand, the case of the pixel 200 shown in FIG. 1B is different from the case of FIG. 1A; the capacitor element 206 is provided so as to be connected to the liquid crystal element 204 in series, and the capacitor element 207 is connected to the liquid crystal element 204 in parallel. Therefore, the ratio of the voltage $V_L$ of the liquid crystal element 204 to the voltage $V_{CS2}$ of the capacitor element 206 corresponds to the ratio of a value obtained by adding the capacitance value of the capacitor element 207 to that of the liquid crystal element 204 to the capacitance value of the capacitor element 206. Accordingly, even when the capacitance value of the capacitor element 206 is set to be large enough to prevent a change in the potential of the pixel electrode due to leakage of charge, by setting the capacitance value of the capacitor element 207 to be large enough to meet the capacitance value of the capacitor element 206, the voltage $V_L$ of the liquid crystal element 204 and the voltage $V_{CS2}$ of the capacitor element 206 can be set so as not to be too different from each other, or preferably, so as to be approximately the same while the capacitance value of the liquid crystal element 204 is kept small. Thus, an alignment state of the liquid crystal molecules can be figured out more certainly while the capacitance of the liquid crystal element 204 is kept small and a change in the potential of the pixel electrode of the liquid crystal element 204 is made considerable.

The comparing circuit 201 compares a potential applied from the pixel 200 to the pixel electrode of the liquid crystal element 204 with a potential REF serving as a reference, and outputs one of two potentials having different values from each other in accordance with a result of the comparison. For example, when the potential of the pixel electrode is higher than the potential REF, a potential OUT1 is output, and when the potential of the pixel electrode is equal to or lower than the potential REF, a potential OUT2 is output. By setting the potential REF to be the same as a potential of the pixel electrode, which may be obtained when the change in alignment of the liquid crystal molecules converges, a potential to be output from the comparing circuit 201 can be different between before and after the converge of the change in alignment of the liquid crystal molecules.

Note that although FIG. 1B illustrates an example of using an operational amplifier as the comparing circuit 201, not being limited to the operational amplifier, any circuit that can output one of two potentials according to a result of comparing the potential applied from the pixel 200 with the potential REF which serves as a reference can be used as the comparing circuit 201.

The control circuit 202 controls driving of the light source 203 in accordance with a potential output from the comparing circuit 201. Specifically, when one of two potentials is output from the comparing circuit 201, the light source 203 is turned on by the control of the control circuit 202, and when the other potential is output from the comparing circuit 201, the light source 203 is turned off by the control of the control circuit 202. Since the value of the potential output from the comparing circuit 201 is different between before and after the converge of the change in alignment of the liquid crystal molecules, the control circuit 202 can control the driving of the light source 203 in accordance with timing when alignment of the liquid crystal molecules is changed.

Therefore, in this invention, since timing when a change in the alignment of the liquid crystal molecules converges can be figured out, timing when the light source 203 is driven can be newly set as appropriate in accordance with this timing of convergence. Accordingly, even when the response speed of the liquid crystals changes, by turning off the light source 203 during a period when the change in alignment of the liquid crystal molecules is considerable, and by turning on the light source 203 during a period when the change in alignment of the liquid crystal molecules converges, moving images can be prevented from appearing blurred.

Note that for a liquid crystal display device, AC driving which inverts the polarity of a voltage to be applied to a liquid crystal element in a predetermined timing is often employed in order to prevent deterioration called burn-in of liquid crystals. For example, in the case where AC driving which inverts the polarity of a voltage to be applied to a liquid crystal element every frame period is employed for the liquid crystal display devices of this invention shown in FIGS. 1A and 1B, timing when a light source is driven is newly set only in a frame period where the polarity of the potential of the pixel electrode is not different from that in a previous frame period. In other frame periods, the light source may be driven in the same timing as that in the just previous frame period. Alternatively, in order to newly set timing when the light source is driven every frame period as appropriate, the potential REF serving as a reference may be changed every frame period, or a comparing circuit and a control circuit corresponding to each polarity may be additionally provided. Moreover, in frame periods having the same polarity, timing when the light source is driven is not always necessary to be newly set. If a temperature change in the liquid crystals is not so considerable, the number of newly setting timing when the light source is driven may be reduced; for example, once in 60 frame periods.

Figure 2:
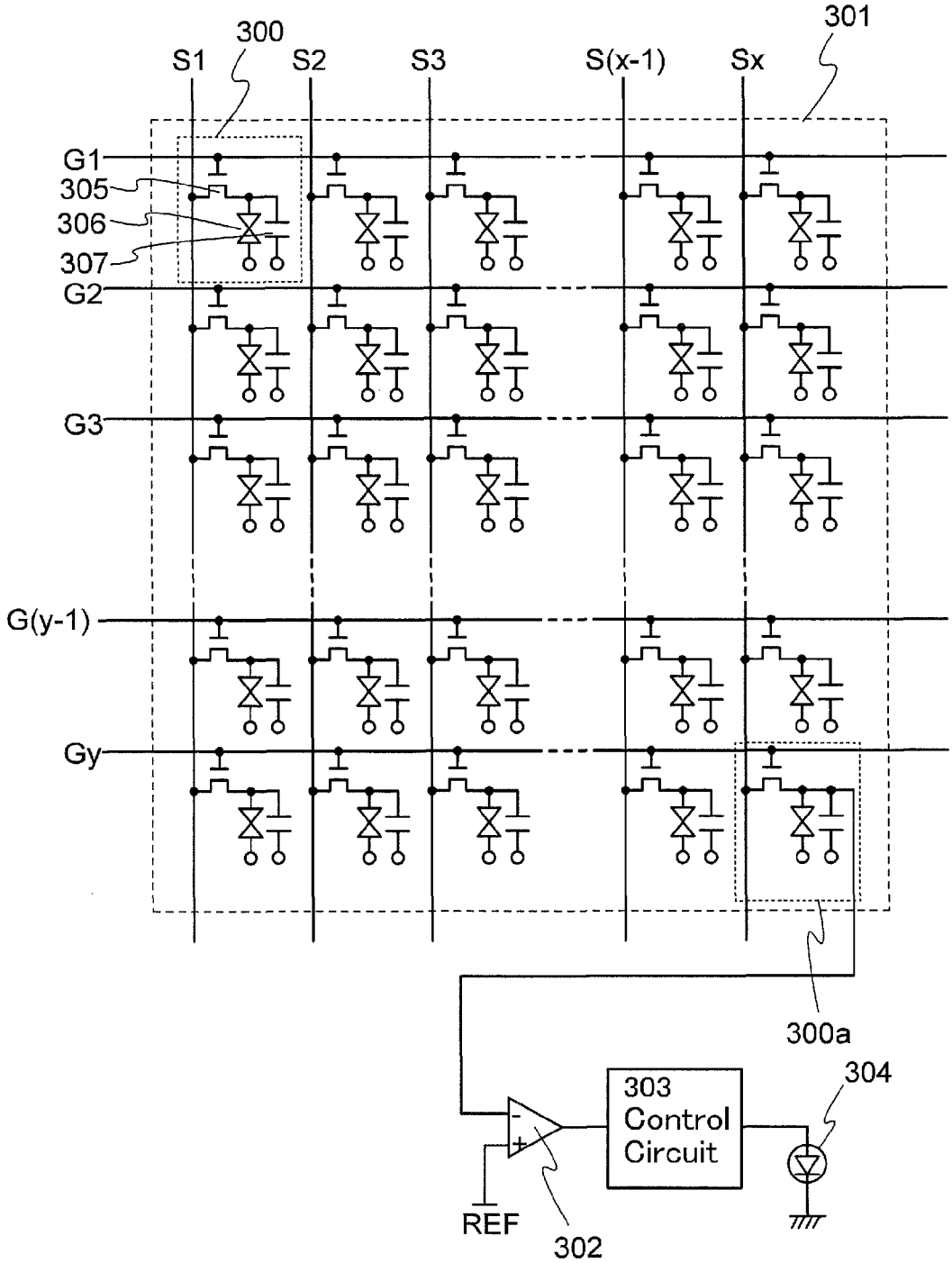
FIG. 2 is a diagram illustrating a structure of a liquid crystal display device according to an aspect of this invention, which includes a plurality of pixels.

Moreover, in a liquid crystal display device of this invention, in the case where a pixel portion includes a plurality of pixels, a potential of the pixel electrode may be output from at least one of the plurality of pixels to the comparing circuit. FIG. 2 shows a pixel portion 301 provided with a plurality of pixels 300, a comparing circuit 302, a control circuit 303, and a light source 304 included in a liquid crystal display device of this invention, as an example.

In FIG. 2, each of the plurality of pixels 300 includes at least one of signal lines S1 to Sx and at least one of scanning lines G1 to Gy. In addition, the pixel 300 includes a transistor 305 which functions as a switching element, a liquid crystal element 306, and a capacitor element 307. Note that although FIG. 2 illustrates the case where one transistor 305 is used as a switching element in the pixel 300, this invention is not limited to this structure. As a switching element, any semiconductor element other than a transistor may be used. Alternatively, a plurality of transistors may be used as a switching element.

Moreover, although FIG. 2 illustrates the case where the liquid crystal element 306 and the capacitor element 307 are connected in series in the pixel 300, as in FIG. 1A, the liquid crystal element 306 and the capacitor element 307 may be connected in parallel. Alternatively, as in FIG. 1B, the pixel 300 may include a capacitor element connected to the liquid crystal element 306 in parallel, in addition to the capacitor element 307 connected to the liquid crystal element 306 in series.

In FIG. 2, of the plurality of pixels 300, in a monitoring pixel 300*a* including a signal line Sx and a scanning line Gy, a potential of a pixel electrode included in the liquid crystal element 306 is input to the comparing circuit 302 to monitor the potential. Note that of all the pixels 300, the pixel 300 in the endmost position is not always necessary to be used as the monitoring pixel 300*a* for monitoring the potential of the pixel electrode. Since the monitoring pixel 300*a* does not need to have a different structure from those of the other pixels 300, a designer can determine which one of the pixels 300 is used as the monitoring pixels 300*a* as appropriate. Alternatively, of the plurality of pixels 300 included in the pixel portion 301, one pixel as a dummy which is actually not to be used for displaying images may be used as the monitoring pixel 300*a*. However, in either case, timing when a change in alignment of the liquid crystal molecules converges comes at the last in a pixel to which a video signal is input at the last included in all the pixels 300. Accordingly, by using a pixel to which a video signal is input at the last as the monitoring pixel 300*a*, timings when the change in alignment of the liquid crystal molecules converges in all the pixels 300 can be figured out, which is preferable.

Next, operation of the pixel portion 301 and driving of the light source 304 which are shown in FIG. 2 will be described. First, when the scanning lines G1 to Gy are sequentially selected, the transistors 305 in the pixels 300 having the selected scanning lines are turned on. Then, when a potential of the video signal is applied to the signal lines S1 to Sx sequentially or at the same time, the potential of the video signal is applied to the pixel electrode of the liquid crystal element 306 through the transistors 305 which are turned on. Next, when the selection of the scanning lines is completed, in the pixels 300 including the selected scanning lines, the transistors 305 are turned off. Then, the potential of the pixel electrode in the liquid crystal element 306 is changed in accordance with the change in alignment of the liquid crystal molecules.

Figure 3:
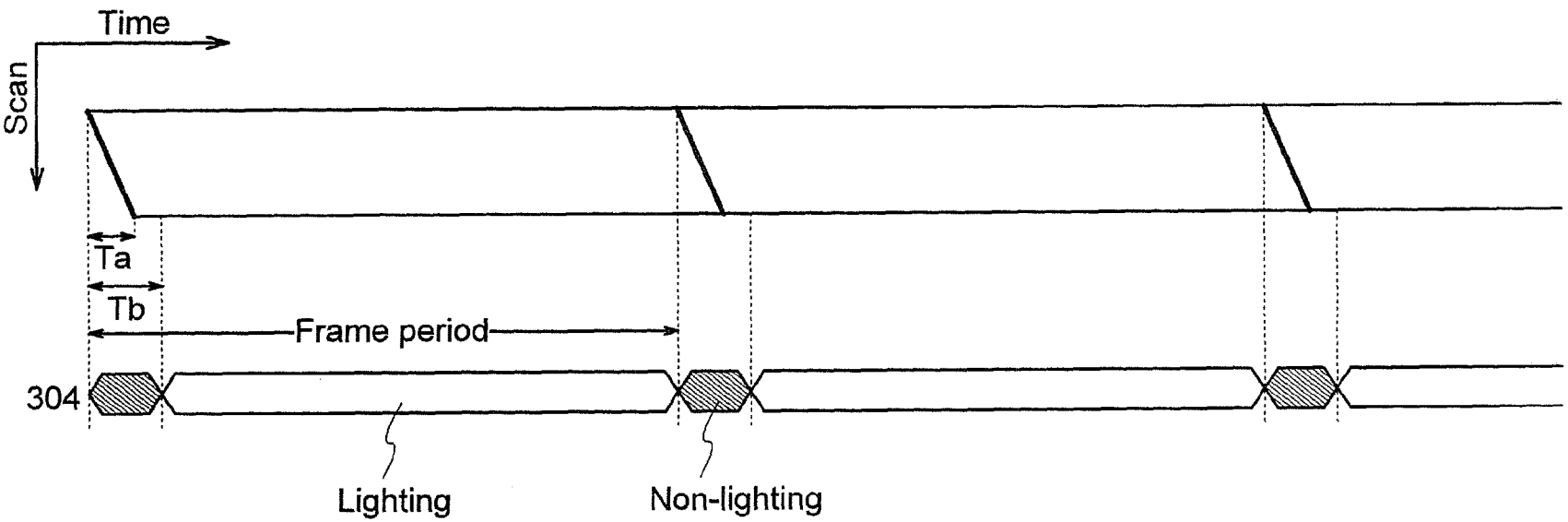
FIG. 3 is timing chart for describing driving of a liquid crystal display device according to an aspect of this invention.

FIG. 3 shows timing when a video signal is input to the pixel 300 in the pixel portion 301. In FIG. 3, the horizontal axis represents time and the vertical axis represents a direction in which a scanning line is selected (a scanning direction). Further, in FIG. 3, lighting periods of the light source 304 are illustrated in white, and non-lighting periods of the light source 304 are illustrated by hatching. A period Ta means a period from when a first scanning line is selected to when a last scanning line is selected, and the video signal is input to all the pixels 300 within the period Ta.

During the period Ta, since the video signal is being input sequentially to the plurality of pixels 300, alignment of the liquid crystal molecules included in the liquid crystal element 306 is changed considerably depending on the pixel 300. Moreover, in the pixel 300 to which the video signal is input at the last during the period Ta, timing when the change in alignment of the liquid crystal molecules converges comes at the last as compared to the other pixels 300. The timing when the change in alignment of the liquid crystal molecules converges is changed as any time also depending on the temperature of the liquid crystals.

Figures 4A, 4B, 4C:
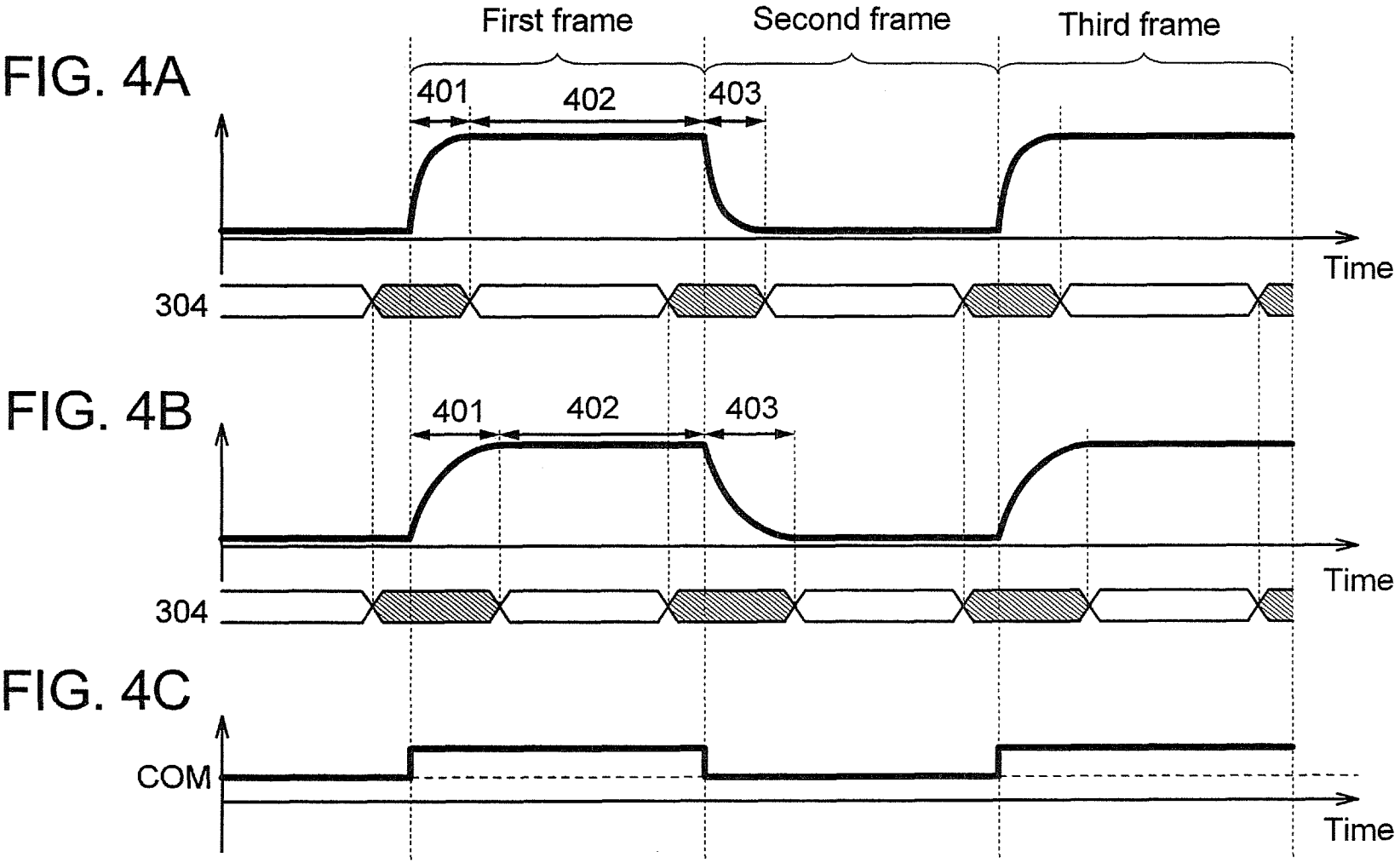
FIGS. 4A and 4B are diagrams each illustrating a time change in the transmittance of a liquid crystal element.
FIG. 4C is a diagram illustrating a time change of a voltage input to a signal line.

FIGS. 4A and 4B each show a time change in the transmittance of the liquid crystal element 306 and timing when the light source is driven in the pixel 300 to which the video signal is input at the last. In FIGS. 4A and 4B, the horizontal axis represents time and the vertical axis represents the transmittance of the liquid crystal element 306. Further, in FIGS. 4A and 4B, lighting periods of the light source 304 are illustrated in white, and non-lighting periods of the light source 304 are illustrated by hatching. In addition, FIG. 4C shows a time change in a potential to be input to a signal line. However, in FIG. 4C, an example is shown in which the potential to be input to the signal line is higher than the potential COM during a first frame period and during a third frame period, and is the same as the potential COM during a second frame period.

The changes in transmittance in FIGS. 4A and 4B synchronize with timing chart shown in FIG. 4C. However, the relative permittivity of the liquid crystals is different due to a temperature change, and the length of a period 401 in which the changes in the transmittance is considerable is different between FIG. 4A and FIG. 4B. More specifically, in FIG. 4A, the period 401 is shorter than that in FIG. 4B and a period 402 is longer than that in FIG. 4B.

In this invention, timing when the change in alignment of the liquid crystal molecules converges can be figured out from the potential of the pixel electrode in the liquid crystal element 306 included in the monitoring pixel 300*a*. Then, the control circuit 303 controls the driving of the light source 304 so as to turn off the light source 304 during a period Tb (see FIG. 3) from when a video signal starts to be input to the pixel 300 to when the change in alignment of the liquid crystal molecules in all the pixels 300 converges. Therefore, in this invention, the light source 304 can be driven so as to be turned off at least during the period 401 in either case of FIGS. 4A and 4B. By keeping the light source 304 turned off during the period Tb, a change in alignment of the liquid crystal molecules, that is, a change in the transmittance of the liquid crystal element is less likely to be seen, whereby moving images can be prevented from appearing blurred.

Note that the period 401 differs not only depending on the relative permittivity of the liquid crystals but also the amount of change in a voltage applied to the liquid crystal element. For example, in the case of VA liquid crystals, since the response speed of the liquid crystals becomes the lowest when black display turns to intermediate grayscale display, the period 401 becomes the longest. Therefore, when timing when the light source 304 is driven is set, a video signal is input to the monitoring pixel 300*a* so as to perform intermediate grayscale display in the second frame period after black display is performed in a previous frame period. Then, the timing when the light source 304 is driven is preferably set in accordance with a potential of the pixel electrode in the second frame period. With the above-described structure, in the case of displaying any gray levels, the driving of the light source 304 is controlled so as to turn off the light source 304 during the period Tb until the change in alignment of the liquid crystal molecules converges, so that moving images can be prevented from appearing blurred.

Note that in the case of VA liquid crystals, although the response speed of the liquid crystals becomes the lowest when black display turns to intermediate grayscale display, display patterns when the response speed of the liquid crystals becomes the lowest differ depending on the kind of the liquid crystals. Therefore, in accordance with the kind of the liquid crystals, when the timing when the light source 304 is driven may be set, a display pattern in which gray levels are changed in the monitoring pixel 300*a* is selected as appropriate so as to make the response speed the lowest. For example, in the case of TN liquid crystals or OCB liquid crystals, the response speed of the liquid crystals becomes the lowest when white display turns to intermediate grayscale display. Accordingly, in that case, a display pattern of performing intermediate grayscale display following white display is preferably employed to set the timing when the light source 304 is driven. Moreover, in the case of IPS liquid crystals, for example, the response speed of the liquid crystals becomes the lowest when black display turns to intermediate grayscale display as in the case of VA liquid crystals. Thus, in that case, timing when the light source 304 is driven is preferably set by employing the display pattern of performing intermediate grayscale display following black display.

In addition, in each of FIGS. 4A and 4B, a change in alignment of the liquid crystal molecules is considerable not only in the period 401 but also period 403. The period 401 is a period with a considerable change in alignment of the liquid crystal molecules, which occurs when the potential of the pixel electrode is changed to a potential that is further different from that of the counter electrode of the liquid crystal element. On the other hand, the period 403 is a period with a considerable change in alignment of the liquid crystal molecules, which occurs when the potential of the pixel electrode is changed to a potential closer to that of the counter electrode of the liquid crystal element. In this embodiment mode, although timing when the light source 304 is driven is set by using a change in a potential of the pixel electrode during the period 401, the timing when the light source 304 is driven may be set by using a change in a potential of the pixel electrode during the period 403. In some cases, the period 403 becomes longer than the period 401 although it depends on the kind of the liquid crystals. Therefore, when the period 403 is longer than the period 401, timing when the light source 304 is driven is set by using the change in the potential of the pixel electrode during the period 403, so that moving images can be more certainly prevented from appearing blurred.

Note that also in the case where timing when the light source 304 is driven is set during the period 403, a display pattern in which the period 403 becomes the longest is preferably employed. For example, in the case of VA liquid crystals, since a response time of the liquid crystals becomes the longest when white display turns to black display, the period 401 becomes the longest. Therefore, when timing when the light source 304 is driven is set, a video signal is input to the monitoring pixel 300*a* so as to perform black display in the second frame period after white display is performed in a previous frame period. Then, the timing when the light source 304 is driven is preferably set in accordance with a potential of the pixel electrode in the second frame period. With the above-described structure, in the case of displaying any gray levels, the driving of the light source 304 is controlled so as to turn off the light source 304 during the period Tb until the change in alignment of the liquid crystal molecules converges, so that moving images can be prevented from appearing blurred.

Note that in the case of VA liquid crystals, although a response time of the liquid crystals becomes the longest when white display turns to black display, display patterns when the response time of the liquid crystals becomes the longest differ depending on the kind of the liquid crystals. Therefore, in accordance with the kind of the liquid crystals, when the timing when the light source 304 is driven may be set, a display pattern is selected as appropriate. For example, in the case of TN liquid crystals or OCB liquid crystals, the response speed of the liquid crystals becomes the lowest when black display turns to white display. Accordingly, in that case, a display pattern of performing white display following black display is preferably employed to set the timing when the light source 304 is driven. Moreover, in the case of IPS liquid crystals, for example, the response speed of the liquid crystals becomes the lowest when white display turns to black display as in the case of VA liquid crystals. Thus, in that case, timing when the light source 304 is driven is preferably set by employing the display pattern of performing black display following white display.

In addition, only one light source 103 is shown in FIG. 1A; only one light source 203, in FIG. 1B; and only one light source 304, in FIG. 2. However, this invention is not limited to these structures. The number of each of the light source 103, the light source 203, and the light source 304 may be one or more.

Note that although an active matrix liquid crystal display device is described as an example in this embodiment mode, a passive matrix liquid crystal display device is also possible in this invention.

Embodiment Mode 2

In this embodiment mode, examples of a specific structure of a control circuit included in a liquid crystal display device of this invention will be described.

Figure 5A:
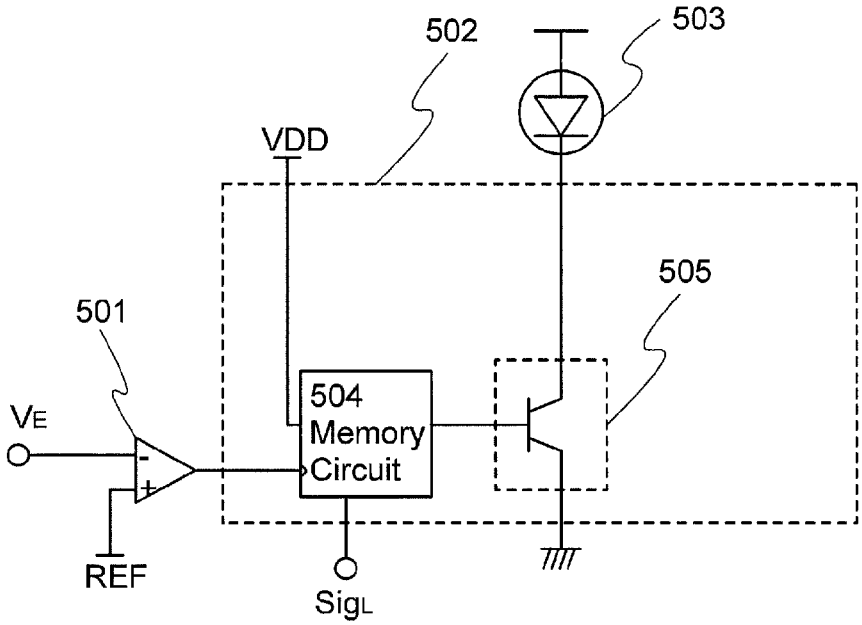
FIGS. 5A and 5B are diagrams each illustrating a specific structure of a control circuit.

FIG. 5A illustrates a comparing circuit 501, a control circuit 502, and a light source 503, which are included in a liquid crystal display device of this invention. The control circuit 502 shown in FIG. 5A includes at least a memory circuit 504 and a switching circuit 505.

A potential $V_E$ of a pixel electrode of a liquid crystal element, which is applied from a pixel, and a potential REF serving as a reference are input to the comparing circuit 501. Then, the comparing circuit 501 compares the potential $V_E$ and the potential REF with each other and outputs one of a potential OUT1 and a potential OUT2, which are different from each other, in accordance with results of the comparison.

In the control circuit 502, whether the potential output from the comparing circuit 501 is the potential OUT1 or the potential OUT2 is stored as data in the memory circuit 504. A power supply potential VDD for holding data stored in the memory circuit 504 and a signal $Sig_L$ for controlling timing when the data is stored are input to the memory circuit 504. In specific, when timing when the light source 503 is driven is set, data is newly written to the memory circuit 504 by the signal $Sig_L$. On the contrary, when timing when the light source 503 is driven is kept as it is set, data is not newly written to the memory circuit 504 by the signal $Sig_L$. Note that in the case where timing when a video signal is input to a first pixel among all the pixels is controlled by the signal $Sig_L$, timing when the light source 503 is turned off can also be controlled by the signal $Sig_L$ in accordance with the timing when the video signal is input to the first pixel.

Timing to set a timing when a light source is driven can be determined as appropriate by a designer as described above. In specific, by using the signal $Sig_L$ or other control signals, the timing to set the timing when the light source is driven can be controlled in real time. Note that in the case where the timing when the light source is driven is not set in real time every frame period but is set every plural frame periods, a timing detecting circuit may be further provided in the control circuit 502 and the timing when the light source 503 is driven, which is set, may be stored in the timing detecting circuit by the time of upcoming setting of the timing when the light source 503 is driven set. For example, as the timing detecting circuit, a circuit for detecting a period from when one frame period is started to when a change in alignment of liquid crystal molecules converges in all the pixels, by using a potential output from the comparing circuit 501 when resetting timing when the light source 503 is driven is directed, a circuit for measuring a time from when each frame period is started, and a circuit for rewriting data in the memory circuit 504 in accordance with signals output from these two circuits described above.

The switching circuit 505 controls electric power supply to the light source 503 by performing switching in accordance with data stored in the memory circuit 504. Note that although FIG. 5A shows an example of using one transistor as the switching circuit 505, this invention is not limited to this structure. A semiconductor element except a transistor or a plurality of transistors can be used as the switching circuit 505. In addition, a latch circuit or the like can be used as the memory circuit 504. An LED (light emitting diode) can be used as the light source 503. Note that a light source that can be used for a liquid crystal display device of this invention is not necessarily limited to the LED. Any light emitting element that can switch turning-on and turning-off at high speed like the LED can be used as the light source of the liquid crystal display device of this invention.

Note that although the structure of the control circuit 502 including the memory circuit 504 is described in this embodiment mode, a memory circuit is not necessarily used as a control circuit included in a liquid crystal display device of this invention. In the case where a memory circuit is not used, the switching circuit 505 is provided to a lower stage of the comparing circuit 501 in the control circuit 502. Moreover, in the case where the memory circuit is not used, since timing when the light source is driven is newly set as appropriate every single frame period, the potential REF serving as a reference is changed every frame period or a comparing circuit and a control circuit corresponding to each polarity are further provided.

Figure 5B:
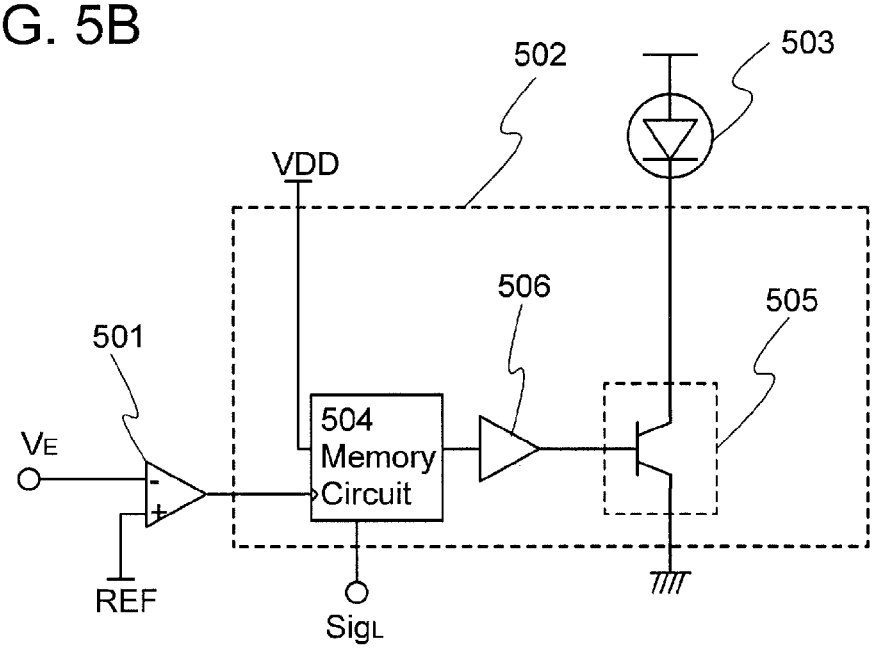

Note that the control circuit 502 may include a buffer in addition to the structure shown in FIG. 5A. FIG. 5B shows the control circuit 502 including a buffer 506 in addition to the comparing circuit 501, and the light source 503. In the control circuit 502 shown in FIG. 5B, a potential output from the memory circuit 504 is input to the control circuit 502 through the buffer 506. By using the buffer 506, even when a large amount of electric power is required for controlling switching in the switching circuit 505, the switching can be surely controlled.

Note that a CPU (central processing unit) can have a function of the control circuit 502 having the structures shown in FIGS. 5A and 5B by using a potential detected by the comparing circuit 501. Note that this invention has an advantage that the driving of the light source 503 can be controlled with respect to the response speed of liquid crystals without using a complicated circuit of a control system with a CPU. Alternatively, even if a CPU is used, this invention has an advantage that the driving of the light source 503 can be controlled with respect to the response speed of liquid crystals while a load of the CPU is suppressed.

Although only one light source 503 is shown in each of FIGS. 5A and 5B, this invention is not limited to this structure. The number of the light sources 503 may be one or more.

This embodiment mode can be implemented in combination with any of the embodiment modes as appropriate

Embodiment Mode 3

Figure 6:
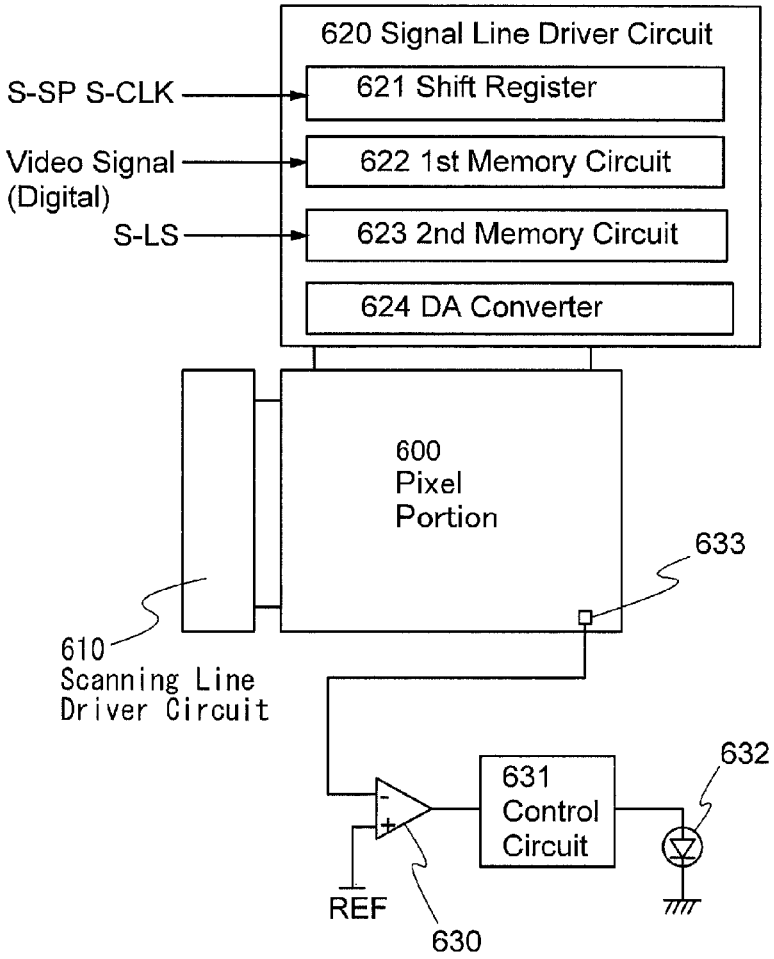
FIG. 6 is a block diagram illustrating a general structure of a liquid crystal display device according to an aspect of this invention.

In this embodiment mode, one example of a general structure of a liquid crystal display device of this invention will be described. In FIG. 6, a block diagram of a liquid crystal display device of this invention is shown.

The liquid crystal display device shown in FIG. 6 includes a pixel portion 600 having a plurality of pixels each provided with a liquid crystal element, a scanning line driver circuit 610 for selecting pixels per line, a signal line driver circuit 620 for controlling input of a video signal to pixels of a selected line, a comparing circuit 630, a control circuit 631, and a light source 632. In addition, in this invention, one the pixels included in the pixel portion 600 is used as a monitoring pixel 633. A potential of a pixel electrode of the monitoring pixel 633 is applied to the comparing circuit 630.

In FIG. 6, the signal line driver circuit 620 includes a shift register 621, a first memory circuit 622, a second memory circuit 623, and a DA (digital to analog) converter 624. A clock signal S-CLK and a start pulse signal S-SP are input to the shift register 621. The shift register 621 generates a timing signal a pulse of which sequentially shifts in accordance with the clock signal S-CLK and the start pulse signal S-SP and outputs the timing signal to the first memory circuit 622. The order of the appearance of the pulses of the timing signal may be switched in accordance with a scanning direction switching signal.

When a timing signal is input to the first memory circuit 622, a video signal is sequentially written into and held in the first memory circuit 622 in accordance with a pulse of the timing signal. Video signals may be sequentially written to a plurality of memory circuits included in the first memory circuit 622; however, the plurality of memory circuits included in the first memory circuit 622 may be divided into some groups, and video signals may be input to respective groups in parallel, that is, a so-called division driving may be performed. Note that the number of groups at this time is called a division number. For example, in the case where a memory circuit is divided into groups such that each group has four memory elements, division driving is performed with four divisions.

The time until writing of the video signals to all the memory elements of the first memory circuit 622 is completed is called a line period. In practice, the line period to which a horizontal retrace interval period is added to the line period is also called a line period in some cases.

When one line period is completed, the video signals held in the first memory circuit 622 are written to the second memory circuit 623 all at once and are held in accordance with a pulse of a latch signal S-LS which is to be input to the second memory circuit 623. The next video signals are sequentially written to the first memory circuit 622 which has finished sending the video signals to the second memory circuit 623, in accordance with a timing signal from the shift register 621 again. During this second round of the one line period, the video signals written to and held in the second memory circuit 623 are input to the DA converter 624.

The DA converter 624 converts an input digital video signal into an analog video signal and inputs the analog video signal to each pixel included in the pixel portion 600 through the signal line.

Note that the signal line driver circuit 620 may use another circuit which can output a signal a pulse of which sequentially shifts instead of the shift register 621.

Note that, although the pixel portion 600 is directly connected to the lower stage of the DA converter 624 in FIG. 6, this invention is not limited to this structure. A circuit which performs signal processing on the video signal output from the DA converter 624 can be provided at a stage prior to the pixel portion 600. As examples of the circuit which performs signal processing, a buffer which can shape a waveform and the like can be given.

Next, operation of the scanning line driver circuit 610 will be described. In a liquid crystal display device of this invention, a plurality of scanning lines is provided for each pixel in the pixel portion 600. The scanning line driver circuit 610 selects a pixel by each line by generating a selecting signal and inputting the selecting signal to each of the plurality of scanning lines. When the pixel is selected by the selecting signal, a switching element included in the pixel is turned on and a video signal is input to the pixel.

Note that although this embodiment mode shows the example in which all the selecting signals to be input to a plurality of scanning lines are generated in one scanning line driver circuit 610, this invention is not limited to this structure. The selecting signals to be input to the plurality of scanning lines may be generated in a plurality of scanning line driver circuits 610.

In addition, although the pixel portion 600, the scanning line driver circuit 610, the signal line driver circuit 620, the comparing circuit 630, and the control circuit 631 can be formed over the same substrate, one or some of them can be formed over a different substrate.

In addition, although FIG. 6 shows only one light source 632, this invention is not limited to this structure. The number of the light sources 632 may be one or more.

Figure 7:
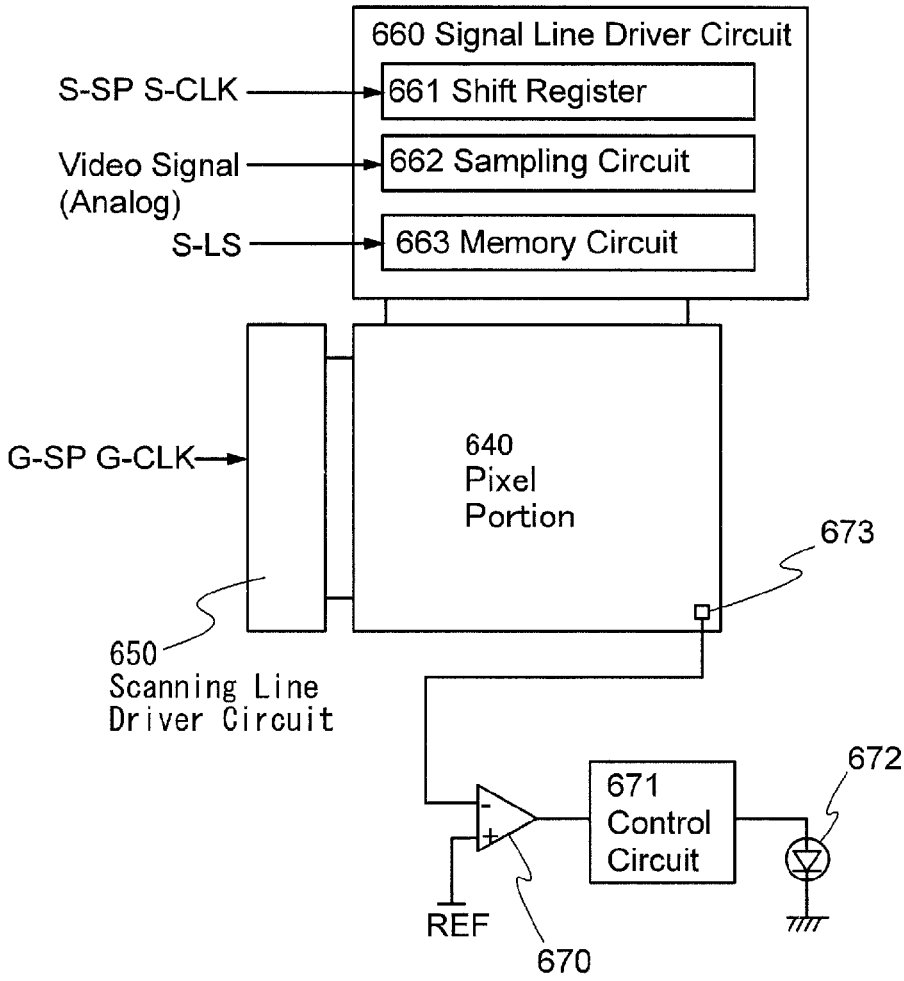
FIG. 7 is a block diagram illustrating a general structure of a liquid crystal display device according to an aspect of this invention.

Next, a block diagram of a liquid crystal display device of this embodiment mode, which is different from that shown in FIG. 6, will be shown in FIG. 7 as an example.

The liquid crystal display device shown in FIG. 7 includes a pixel portion 640 having a plurality of pixels, a scanning line driver circuit 650 for selecting a plurality of pixels per line, a signal line driver circuit 660 for controlling input of a video signal to pixels of a selected line, a comparing circuit 670, a control circuit 671, and a light source 672. In addition, in this invention, one of the pixels included in the pixel portion 640 is used as a monitoring pixel 673. A potential of a pixel electrode of the monitoring pixel 673 is applied to the comparing circuit 670.

The signal line driver circuit 660 includes at least a shift register 661, a sampling circuit 662, and a memory circuit 663 which can store an analog signal. When a clock signal S-CLK and a start pulse signal S-SP are input to the shift register 661, the shift register 661 generates a timing signal a pulse of which sequentially shifts in accordance with the clock signal S-CLK and the start pulse signal S-SP and inputs the timing signal to the sampling circuit 662. The sampling circuit 662 samples analog video signals for one line period, which are input to the signal line driver circuit 660, in accordance with the timing signal input. When all the video signals for one line period are sampled, the sampled video signals are output to the memory circuit 663 all at once and are held in accordance with the latch signal S-LS. The video signals held in the memory circuit 663 are input to the pixel portion 640 through the signal line.

Note that although this embodiment mode shows the example in which after the video signals for one line period are sampled in the sampling circuit 662, all the sampled video signals are input to the memory circuit 663 in a lower stage all at once, this invention is not limited to this structure. Every time the video signals corresponding to the respective pixels are sampled in the sampling circuit 662, the video signal sampled can be input to the memory circuit 663 in the lower stage without waiting for the completion of the one line period.

The video signal may be sequentially sampled with respect to a pixel corresponding the video signal. Alternatively, pixels in one line may be divided into some groups so that the video signal may be sampled with respect to pixels corresponding to each group in parallel.

Note that, although the pixel portion 640 is directly connected to the lower stage of the memory circuit 663 in FIG. 7, this invention is not limited to this structure. A circuit which performs signal processing on the analog video signal output from the memory circuit 663 can be provided at a stage prior to the pixel portion 640. As examples of the circuit which performs signal processing, a buffer which can shape a waveform, and the like can be given.

Then, at the same time as the video signal is input to the pixel portion 640 from the memory circuit 663, the sampling circuit 662 can sample video signals corresponding to the next line period again.

Next, operation of the scanning line driver circuit 650 will be described. In a liquid crystal display device of this invention, a plurality of scanning lines is provided for each pixel in the pixel portion 640. The scanning line driver circuit 650 selects a pixel with respect to each line by generating a selecting signal and inputting the selecting signal to each of the plurality of the scanning lines. When a pixel is selected by the selecting signal, a switching element included in the pixel is turned on and a video signal is input to the pixel.

Note that although this embodiment shows an example in which all the selecting signals to be input to a plurality of scanning lines are generated in one scanning line driver circuit 650, this invention is not limited to this structure. The selecting signals to be input to a plurality of scanning lines may be generated in a plurality of scanning line driver circuits 650.

In addition, although the pixel portion 640, the scanning line driver circuit 650, the signal line driver circuit 660, the comparing circuit 670, and the control circuit 671 may be formed over the same substrate, one or some of them may be formed over a different substrate.

In addition, although FIG. 7 shows only one light source 672, this invention is not limited to this structure. The number of the light sources 672 may be one or more.

This embodiment mode can be implemented in combination with any of the embodiment modes as appropriate.

Embodiment Mode 4

In this embodiment mode, a structure of a liquid crystal display device that detects the luminance in an environment where the liquid crystal display device is set and adjusts the luminance of a light source in accordance with the luminance detected will be described.

Figure 8A:
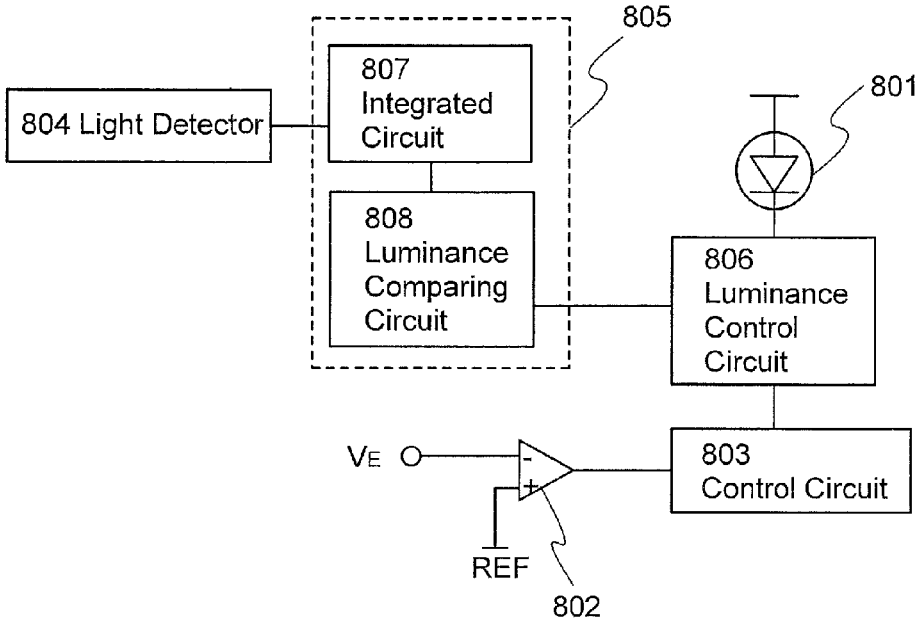
FIGS. 8A and 8B are diagrams illustrating a specific structure of a control circuit.

FIG. 8A shows an example of a circuit of a control system for a light source 801 included in a liquid crystal display device of this embodiment mode. The circuit of the control system for the light source 801 shown in FIG. 8A includes a comparing circuit 802, a control circuit 803, a light detector 804, a signal generating circuit 805, and a luminance control circuit 806.

The comparing circuit 802 compares the potential $V_E$ of a pixel electrode of a liquid crystal element, which is applied from a pixel, and the potential REF serving as a reference with each other, and outputs one of two potentials having different values from each other in accordance with the results of the comparison. The control circuit 803 controls the driving of the light source 801 in accordance with a potential output from the comparing circuit 802. Specifically, when one of two potentials is output from the comparing circuit 802, the light source 801 is turned on by the control of the control circuit 803; and when the other potential is output from the comparing circuit 802, the light source 801 is turned off by the control of the control circuit 803. Since the value of the potential output from the comparing circuit 802 is different between before and after the convergence of a change in alignment of the liquid crystal molecules, the control circuit 803 can control the driving of the light source 801 in accordance with timing when alignment of the liquid crystal molecules is changed.

The light detector 804 can detect the luminance or the intensity of light in an environment where the liquid crystal display device is set and can generate an electric signal (a first signal) including information related to the luminance or the intensity of light. As the light detector 804, for example, a photoelectric conversion element that converts light into electric energy, such as a photodiode, a photo transistor, or a CCD (charge coupled device) can be used.

The signal generating circuit 805 determines the luminance of the light source 801 in accordance with information related to the luminance detected by using an electric signal generated in the light detector 804. In FIG. 8A, an example in which the signal generating circuit 805 includes an integrating circuit 807 and a luminance comparing circuit 808 is shown.

The integrating circuit 807 integrates the intensity of light detected in the light detector 804 with respect to time. Since humans have a characteristic of perceiving the intensity of light in a certain period by integration, luminance which is perceived by human eyes can be calculated by using the integrating circuit 807. The luminance comparing circuit 808 compares luminance calculated by the integrating circuit 807 with luminance to be a reference which is set in advance.

Then, a signal (a second signal) including information related to results of the comparison is output. The luminance control circuit 806 uses the second signal as a signal for adjusting the luminance of a light source to control the luminance of the light source 801 in accordance with results of the comparison in the luminance comparing circuit 808. Specifically, the luminance of the light source 801 is controlled in accordance with the second signal as follows; if luminance calculated is higher than luminance set, the luminance of the light source 801 is controlled to be higher, and if luminance calculated is lower than luminance set, the luminance of the light source 801 is controlled to be lower.

Therefore, a liquid crystal display device of this embodiment mode can increase the luminance of the light source 801 if luminance in an environment where the liquid crystal display device is set is high and can decrease the luminance of the light source 801 if luminance in an environment where the liquid crystal display device is set is low. With the above-described structure, an image displayed on a liquid crystal display device may be conspicuous by brightening the image in a bright area; on the other hand, power consumption can be reduced by suppressing brightness of the image in a dark area.

Note that the number of luminance to be a reference is not necessarily one and a plurality of luminances may be set as references. For example, in the case where three luminances of a first luminance, a second luminance, and a third luminance in order of ascending, to be references are set, the luminance of the light source 801 when it is on is made to be adjusted by four levels. Then, if luminance calculated is lower than the first luminance, the light source 801 is turned on in accordance with the second signal so as to have the lowest luminance among the four levels. Moreover, if the luminance calculated is higher than the first luminance and lower than the second luminance, the light source 801 is turned on in accordance with the second signal so as to have the second lowest luminance among the four levels. Further, if the luminance calculated is higher than the second luminance and lower than the third luminance, the light source 801 is turned on so as to have the second highest luminance in the four levels in accordance with the second signal. Furthermore, if the luminance calculated is higher than the third luminance, the light source 801 is turned on in accordance with the second signal so as to have the highest luminance among the four levels.

Further, in addition to the above-described effect, since the liquid crystal display device of this embodiment mode can figure out timing when a change in alignment of liquid crystal molecules converges, timing when the light source 801 is driven can be newly set as appropriate in accordance with the timing when the change in alignment of the liquid crystal molecules converges. Accordingly, even if the response speed of liquid crystals is changed, the light source 801 is off during a period when a change in alignment of liquid crystal molecules is considerable, and the light source 801 is on during a period when a change in alignment of liquid crystal molecules converges, so that moving images can be prevented from appearing blurred.

Figure 8B:
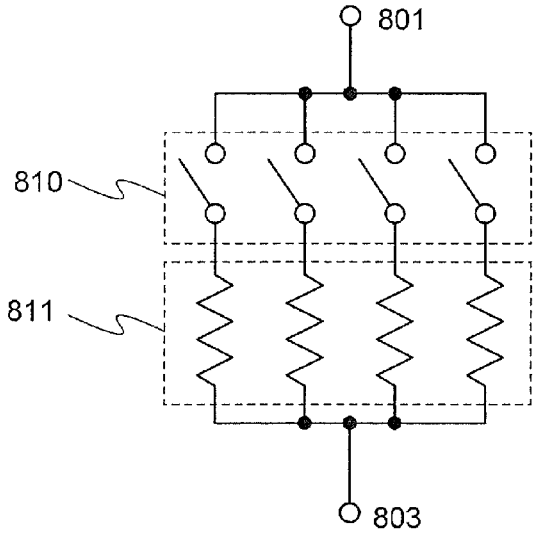

Next, FIG. 8B shows a specific example of a circuit in the luminance control circuit 806. FIG. 8B illustrates the case where the luminance control circuit 806 controls the luminance of the light source 801 by four levels and includes four switching elements 810 and four resistor elements 811. Each of the switching elements 810 is connected to each of the resistor elements 811 in series. Four combinations of the switching element 810 and the resistor element 811 connected in series are connected all in parallel between the control circuit 803 and the light source 801.

Switching of each of the switching elements 810 is performed in accordance with the second signal output from the signal generating circuit 805. The larger the number of switching elements 810 turned on becomes, the lower a resistance value between the control circuit 803 and the light source 801 becomes. On the contrary, the smaller the number of switching elements 810 turned on becomes, the higher a resistance value between the control circuit 803 and the light source 801 becomes. Thus, when electric power is supplied in accordance with timing set in the control circuit 803, the electric power supplied to the light source 801 can be adjusted in accordance with the switching of each of the switching elements 810, so that the luminance of the light source 801 can be controlled by four levels.

Note that the luminance control circuit 806 may only control the amount of electric power supplied to the light source 801 because whether electric power is supplied to the light source 801 or not is controlled by the control circuit 803. Therefore, at least one of the plurality of switching elements 810 is on all the time. However, this invention is not limited to this structure; and all the switching elements 810 may be made to be turned off in order to control whether electric power is supplied to the light source 801 or not also by the luminance control circuit 806.

In addition, if m resistor elements 811 all have the same resistance value, luminance is controlled by m levels. However, by changing the resistance value of each of the resistor elements 811, luminance can be accurately controlled by $(2^m-1)$ levels.

In addition, although FIG. 8 shows only one light source 801, this invention is not limited to this structure. The number of the light sources 801 may be one or more.

This embodiment mode can be implemented in combination with any of the embodiment modes as appropriate.

Embodiment Mode 5

In this embodiment mode, a structure of a liquid crystal display device will be described in which a pixel portion included in the liquid crystal display device is divided into a plurality of regions, so that the luminance of light sources corresponding to the respective regions is adjusted in accordance with the average value of gray levels of pixels provided in the respective regions.

Figure 9A:
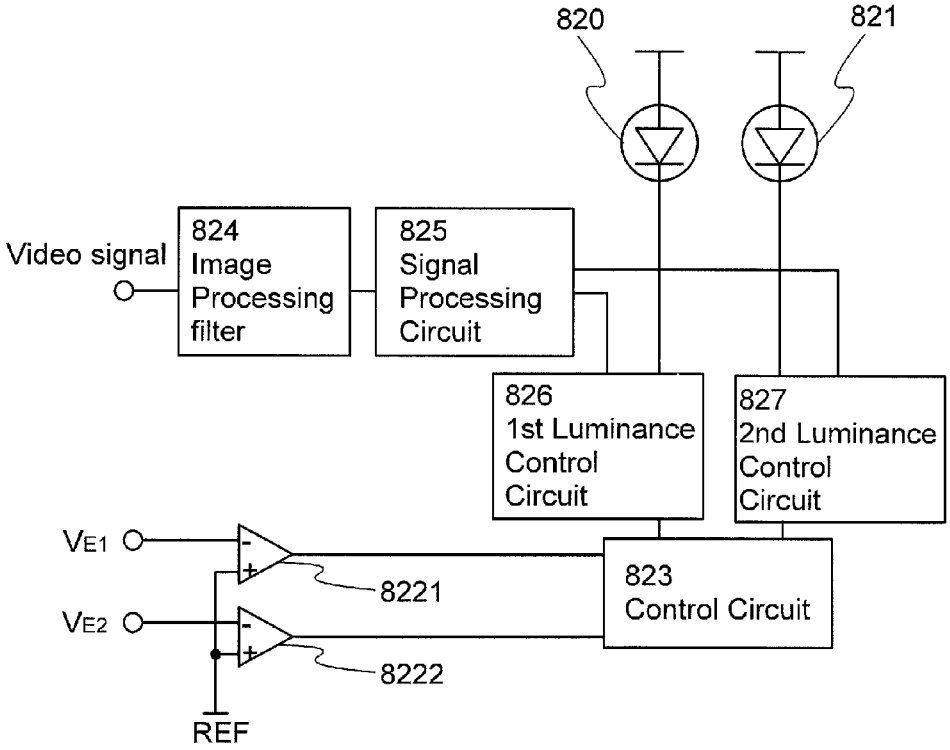
FIGS. 9A and 9B are diagrams each illustrating a specific structure of a control circuit.

A liquid crystal display device of this embodiment mode has a plurality of light sources corresponding to respective regions. FIG. 9A shows one example of a circuit of a control system for a first light source 820 and a second light source 821 which correspond to a pixel in a first region and a pixel in a second region, respectively, included in a liquid crystal display device. Note that the number of light sources is not limited to two and can be set as appropriate in accordance with the number of corresponding regions which are divided.

The circuit of the control system for the first light source 820 and the second light source 821 shown in FIG. 9A includes comparing circuits (comparing circuits 8221 and 8222), a control circuit 823, an image processing filter 824, a signal processing circuit 825, a first luminance control circuit 826, and a second luminance control circuit 827.

The comparing circuit 8221 compares a potential $V_{E1}$ of a pixel electrode in a liquid crystal element, which is applied from the pixel in the first region, with a potential REF serving as a reference and outputs one of two potentials having different values from each other to the control circuit 823 in accordance with the results of the comparison.

The comparing circuit 8222 compares a potential $V_{E2}$ of a pixel electrode in a liquid crystal element, which is applied from the pixel in the second region, and the potential REF to be the reference and outputs one of two potentials having different values from each other to the control circuit 823 in accordance with the results of the comparison.

The control circuit 823 controls driving of the first light source 820 and the second light source 821 in accordance with potentials output from the comparing circuits 8221 and 8222. In specific, when one of two potentials is output from the comparing circuit 8221 to the control circuit 823, the control circuit 823 controls the first light source 820 to turn it on. On the other hand, when the other potential is output to the control circuit 823, the control circuit 823 controls the first light source 820 to turn it off. In addition, when one of two potentials is output from the comparing circuit 8222 to the control circuit 823, the control circuit 823 controls the second light source 821 to turn it on. On the other hand, when the other potential is output to the control circuit 823, the control circuit 823 controls the second light source 821 to turn it off. The values of potentials output from the comparing circuits 8221 and 8222 before converging of a change in alignment of liquid crystal molecules are different from those after converging of the change in alignment of the liquid crystal molecules. Therefore, the control circuit 823 can control the driving of the first light source 820 and the second light source 821 in accordance with timing when alignment of the liquid crystal molecules changes.

On the other hand, the image processing filter 824 calculates the average value of gray levels in pixels provided in respective regions by using a video signal input to the pixels in the respective regions, and generates a signal including the average value as information. As the image processing filter 824, for example, an image processing filter that can calculate the average value of gray levels, such as a rank filter or combo filter, can be used.

The signal processing circuit 825 determines the luminance of the first light source 820 and the second light source 821 in accordance with the average value of gray levels, which is calculated by using a signal generated in the image processing filter 824. In specific, the signal processing circuit 825 compares the calculated average value of the gray levels with gray levels set in advance. Then, the signal processing circuit 825 outputs a signal including results of the comparison as information. The first luminance control circuit 826 and the second luminance control circuit 827 use the signal including the results of the comparison as a signal for adjusting the luminance of the first light source 820 and the second light source 821 to control the luminance thereof. Specifically, the luminance of the first light source 820 and the second light source 821 is controlled as follows; if the calculated average value of gray levels is higher than the gray levels set in advance, the luminance of the first light source 820 and the second light source 821 is controlled to be higher; and if the calculated average value of gray levels is lower than the gray levels set in advance, luminance of the first light source 820 and the second light source 821 is controlled to be lower.

Figure 9B:
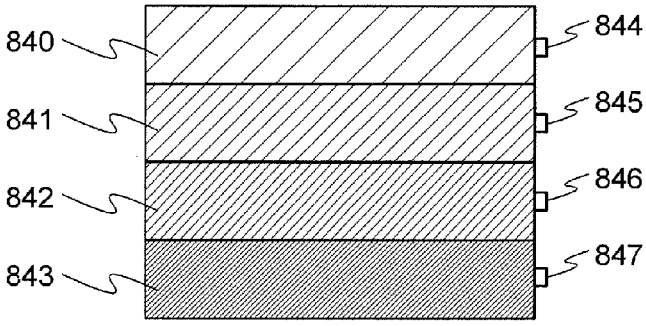

FIG. 9B shows one example of arrangement of a pixel portion divided into four regions 840, 841, 842, and 843, and light sources 844, 845, 846, and 847 corresponding to the regions 840, 841, 842, and 843, respectively. Note that in fact, a region besides a region corresponding to a light source is also irradiated with light from the light source in many cases. However, any light source may be used as long as the region corresponding to the light source can be mainly irradiated with light.

It is assumed that the results of averaging gray levels in pixels each provided for the regions 840, 841, 842, and 843 are that the averaged gray level is low in order of the region 843, the region 842, the region 841, and the region 840. In that case, the luminance of the light source may be made low in order of the light source 847, the light source 846, the light source 845, and the light source 844.

Note that although FIG. 9B illustrates light sources of an edge-light type where a light source is provided on an edge of a pixel portion, a direct type where light sources are provided directly below a pixel portion may be employed in a liquid crystal display device of this invention. In addition, although one first light source 820 and one second light source 821 are shown in FIG. 9A, this invention is not limited to this structure. The number of each of first light sources 820 and second light sources 821 may be one or more.

Thus, a liquid crystal display device of this embodiment mode can display images more brightly in a region with a high gray level, where bright images are displayed, and display images more darkly in a region with a low gray level where dark images are displayed. With the above-described structure, contrast in an image displayed in the entire pixel portion can be increased in the liquid crystal display device of this embodiment mode.

Further, in addition to the above-described effect, since the liquid crystal display device of this embodiment mode can figure out timing when a change in alignment of liquid crystal molecules converges, timing when each of the first light source 820 and the second light source 821 is driven can be newly set as appropriate in accordance with the timing when the change in alignment of the liquid crystal molecules converges. Accordingly, even if the response speed of liquid crystals is changed, the first light source 820 and the second light source 821 are off during a period when a change in alignment of liquid crystal molecules is considerable, and the first light source 820 and the second light source 821 are on during a period when a change in alignment of liquid crystal molecules converges, so that moving images can be prevented from appearing blurred.

Note that although the first luminance control circuit 826 and the second luminance control circuit 827 are provided so as to correspond to the first light source 820 and the second light source 821, respectively, in the liquid crystal display device shown in FIG. 9A, this invention is not limited to this structure. Gray levels of a plurality of light sources may be controlled by one luminance control circuit. In addition, each of the first luminance control circuit 826 and the second luminance control circuit 827 may have the structure of the luminance control circuit shown in FIG. 8B.

Note that also in the case where the luminance of light sources corresponding to respective regions of the pixel portion are controlled as described in this embodiment mode, luminance in an environment where the liquid crystal display device is used may be detected so that the luminance of each light source is adjusted in accordance with the luminance detected.

In addition, this embodiment mode can be implemented in combination with any of the embodiment modes except embodiment mode 4 as appropriate.

Embodiment Mode 6

Figure 10:
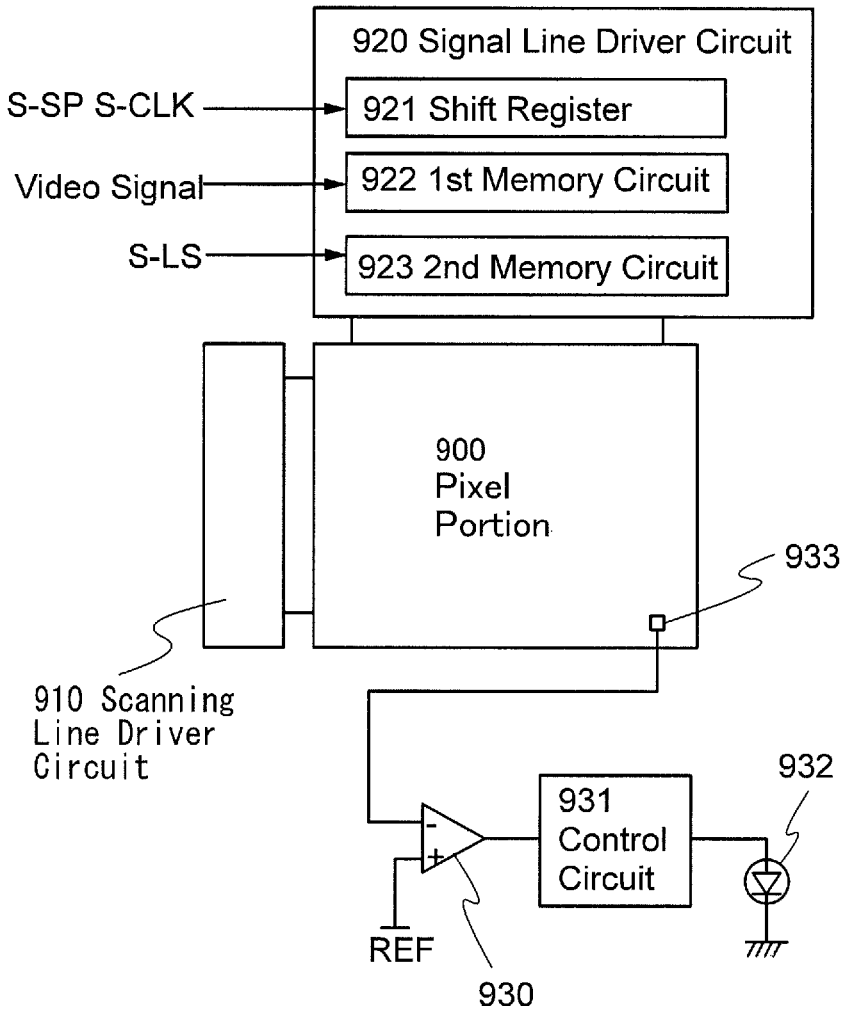
FIG. 10 is a block diagram illustrating a general structure of a liquid crystal display device according to an aspect of this invention.

In this embodiment mode, one example of a general structure of a liquid crystal display device of this invention, which is different from that shown in Embodiment Mode 3, will be described. FIG. 10 illustrates a block diagram of a liquid crystal display device of this invention.

The liquid crystal display device shown in FIG. 10 includes a pixel portion 900 having a plurality of pixels each provided with a liquid crystal element, a scanning line driver circuit 910 for selecting pixels per line, a signal line driver circuit 920 for controlling input of a video signal to pixels of a selected line, a comparing circuit 930, a control circuit 931, and a light source 932. In addition, in this invention, one of the pixels included in the pixel portion 900 is used as a monitoring pixel 933. A potential of a pixel electrode of the monitoring pixel 933 is applied to the comparing circuit 930.

In FIG. 10, the signal line driver circuit 920 includes a shift register 921, a first memory circuit 922, and a second memory circuit 923. A clock signal S-CLK and a start pulse signal S-SP are input to the shift register 921. The shift register 921 generates a timing signal a pulse of which sequentially shifts in accordance with the clock signal S-CLK and the start pulse signal S-SP and outputs the timing signal to the first memory circuit 922. The order of the appearance of the pulses of the timing signal may be switched in accordance with a scanning direction switching signal.

When a timing signal is input to the first memory circuit 922, a video signal is sequentially written into and held in the first memory circuit 922 in accordance with a pulse of the timing signal. Video signals may be sequentially written to a plurality of memory circuits included in the first memory circuit 922; however, the plurality of memory circuits included in the first memory circuit 922 may be divided into some groups, and video signals may be input to respective groups in parallel, that is, a so-called division driving may be performed. Note that the number of groups at this time is called a division number. For example, in the case where a memory circuit is divided into groups such that each group has four memory elements, division driving is performed with four divisions.

The time until writing of a video signal to all the memory elements of the first memory circuit 922 is completed is called a line period. In practice, the line period to which a horizontal retrace interval period added to the line period is also called a line period in some cases.

When one line period is completed, the video signals held in the first memory circuit 922 are written to the second memory circuit 923 all at once and are held in accordance with a pulse of the latch signal S-LS which is to be input to the second memory circuit 923. The next video signals are sequentially written to the first memory circuit 922 which has finished sending the video signals to the second memory circuit 923, in accordance with a timing signal from the shift register 921 again. During this second round of the one line period, the video signals written to and held in the second memory circuit 923 are input as the digital video signals to the respective pixels in the pixel portion 900 through a signal line.

Note that the signal line driver circuit 920 may use another circuit that can output a signal whose pulse sequentially shifts instead of the shift register 921.

Note that the pixel portion 900 is directly connected to the lower stage of the second memory circuit 923 in FIG. 10; however, this invention is not limited to this structure. A circuit that performs signal processing on the video signal output from the second memory circuit 923 may be provided at the stage prior to the pixel portion 900. As examples of the circuit that performs signal processing, a buffer which can shape a waveform, a level shifter which controls the amplitude of voltage, and the like are given.

Next, operation of the scanning line driver circuit 910 will be described. In a liquid crystal display device of this invention, a plurality of scanning lines is provided for each pixel in the pixel portion 900. The scanning line driver circuit 910 generates a selection signal and inputs the selection signal to each of the plurality of scanning lines to select pixels per line. When a pixel is selected by the selection signal, the switching element included in the pixel is turned on and a video signal is input to the pixel.

Note that in this embodiment mode, although the example is described in which all the selection signals input to the plurality of scanning lines are generated in one scanning line driver circuit 910, this invention is not limited thereto. The selection signals input to the plurality of scanning lines can be generated in a plurality of scanning line driver circuits 910.

In the liquid crystal display device in this embodiment mode, a digital video signal is input to the pixel portion 900. When the video signal input to the pixel portion 900 is a digital signal, grayscale may be displayed by controlling a time of white display in a pixel (time ratio grayscale method), or grayscale may be displayed in accordance with the area of a pixel that performs white display (area ratio grayscale method). For example, when a time ratio grayscale method is used in this embodiment mode, one frame period is divided into a plurality of sub-frame periods corresponding to respective bits of a video signal. Then, the total length of sub-frame periods during which the pixel performs white display in one frame period is controlled by the video signal, so that grayscale can be displayed.

In addition, although the pixel portion 900, the scanning line driver circuit 910, the signal line driver circuit 920, the comparing circuit 930, and the control circuit 931 can be formed over the same substrate, one or some of them can be formed over a different substrate.

In addition, although FIG. 10 shows only one light source 932, this invention is not limited to this structure. The number of the light sources 932 may be one or more.

This embodiment mode can be implemented in combination with any of the embodiment modes as appropriate.

Embodiment 1

Next, a manufacturing method of a liquid crystal display device of this invention will be described in detail. Although this embodiment illustrates a thin film transistor (TFT) as an exemplary semiconductor element, a semiconductor element used in the liquid crystal display device of this invention is not limited to this. For example, not only a TFT but also a memory element, a diode, a resistor element, a coil, a capacitor element, an inductor, or the like can be used.

Figure 11A:
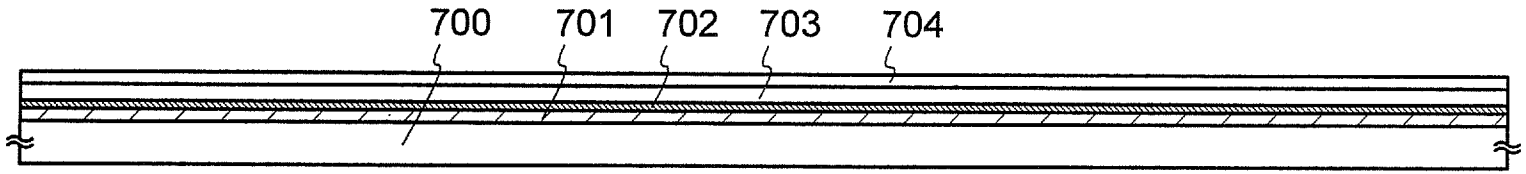
FIGS. 11A to 11C are diagrams illustrating a manufacturing method of a liquid crystal display device according to an aspect of this invention.

First, as shown in FIG. 11A, an insulating film 701, a separation layer 702, an insulating film 703, and a semiconductor film 704 are formed sequentially over a substrate 700 having a heat-resisting property. The insulating film 701, the separation layer 702, the insulating film 703, and the semiconductor film 704 can be formed in succession.

As the substrate 700, a glass substrate such as barium borosilicate glass or aluminoborosilicate glass, a quartz substrate, a ceramic substrate, or the like can be used. Further, a metal substrate including a stainless-steel substrate or a semiconductor substrate such as a silicon substrate may be used as well. A substrate made of a synthetic resin having flexibility such as plastics which generally has the heat-resistance temperature which is lower than those of the above-described substrates can be used as long as it can withstand the process temperature in a manufacturing process.

As a plastic substrate, polyester typified by polyethylene terephthalate (PET); polyether sulfone (PES); polyethylene naphthalate (PEN); polycarbonate (PC); polyether etherketone (PEEK); polysulfone (PSF); polyether imide (PEI); polyarylate (PAR); polybutylene terephthalate (PBT); polyimide; an acrylonitrile butadiene styrene resin; poly vinyl chloride; polypropylene; poly vinyl acetate; an acrylic resin; and the like can be given.

Although the separation layer 702 is provided over the entire surface of the substrate 700 in this embodiment, the invention is not limited thereto. For example, the separation layer 702 may be formed partly over the substrate 700 by a photolithography method or the like.

The insulating films 701 and 703 are formed by using an insulating material such as silicon oxide, silicon nitride, silicon oxynitride ($SiO_xN_y$ where x>y>0), or silicon nitride oxide ($SiN_xO_y$ where x>y>0) by a CVD method, a sputtering method, or the like.

The insulating film 701 and the insulating film 703 are provided to prevent an alkali metal such as Na or an alkaline earth metal contained in the substrate 700 from diffusing into the semiconductor film 704 and having an adverse effect on a characteristic of a semiconductor element such as a TFT. Further, the insulating film 703 also has roles of preventing an impurity element contained in the separation layer 702 from diffusing into the semiconductor film 704 and of protecting a semiconductor element in a subsequent step in which the semiconductor element is separated from the substrate 700.

Each of the insulating films 701 and 703 can be either a single insulating film or stacked layers of a plurality of insulating films. In this embodiment, a silicon oxynitride film with a thickness of 100 nm, a silicon nitride oxide film with a thickness of 50 nm, and a silicon oxynitride film with a thickness of 100 nm are stacked in this order to form the insulating film 703; however, the materials and film thicknesses of each layer and the number of layers stacked are not limited thereto. For example, instead of the silicon oxynitride film, which is a lower layer, a siloxane-based resin with a thickness of 0.5 to 3 μm may be formed by a spin coating method, a slit coater method, a droplet discharge method, a printing method, or the like. Instead of the silicon nitride oxide film, which is a middle layer, a silicon nitride film may be used. Instead of the silicon oxynitride film which is an upper layer, a silicon oxide film may be used. The thickness of each film is preferably in the range of 0.05 to 3 μm and can be selected from that range at will.

Alternatively, the lower layer which is the closest to the separation layer 702, the middle layer, and the upper layer of the insulating film 703 may be formed of a silicon oxynitride film or a silicon oxide film, a siloxane-based resin, and a silicon oxide film, respectively.

Note that a siloxane-based resin is a resin formed from a siloxane-based material as a starting material and having the bond of Si—O—Si. A siloxane-based resin may contain as a substituent at least one of fluorine, an alkyl group, and aromatic hydrocarbon, in addition to hydrogen.

The silicon oxide film can be formed using a mixed gas of a combination of silane and oxygen, TEOS (tetraethoxysilane) and oxygen, or the like by a method such as thermal CVD, plasma CVD, atmospheric pressure CVD, or bias ECRCVD. In addition, a silicon nitride film can be typically formed using a mixed gas of silane and ammonia by a plasma CVD method. Moreover, a silicon oxynitride film and a silicon nitride oxide film can typically be formed using a mixed gas of silane and nitrous oxide by a plasma CVD method.

As the separation layer 702, a metal film, a metal oxide film, or a film in which a metal film and a metal oxide film are stacked can be used. The metal film and the metal oxide film can be either a single layer or a stacked structure of a plurality of layers. In addition to a metal film or a metal oxide film, metal nitride or metal oxynitride can also be used. The separation layer 702 can be formed by a sputtering method or a CVD method such as a plasma CVD method.

Examples of metals used for the separation layer 702 include tungsten (W), molybdenum (Mo), titanium (Ti), tantalum (Ta), niobium (Nb), nickel (Ni), cobalt (Co), zirconium (Zr), zinc (Zn), ruthenium (Ru), rhodium (Rh), palladium (Pd), osmium (Os), iridium (Ir), and the like. In addition to such metal films, the separation layer 702 can also be formed using a film made of an alloy containing the above-described metal as a main component or a compound containing the above-described metal.

Alternatively, the separation layer 702 may be formed using a film formed of only a silicon (Si) or a film formed of a compound containing silicon (Si) as a main component. As a further alternative, the separation layer 702 may be formed using a film formed of an alloy of silicon (Si) and any of the above-described metals. A film containing silicon may be any of amorphous, microcrystalline, or polycrystalline.

The separation layer 702 may be either a single layer of the above-described film or stacked layers thereof. The separation layer 702 having a stack of a metal film and a metal oxide film can be formed by forming a base metal film and then, oxidizing or nitriding the surface of the metal film. Specifically, plasma treatment may be applied to the base metal film in an oxygen atmosphere or a nitrous oxide atmosphere, or thermal treatment may be applied to the metal film in an oxygen atmosphere or a nitrous oxide atmosphere. Alternatively, the metal film can be oxidized by forming a silicon oxide film or silicon oxynitride film so as to be in contact with the base metal film. Further alternatively, the metal film can be nitrided by forming a silicon nitride oxide film or a silicon nitride film so as to be in contact with the base metal film.

As a plasma treatment which oxidizes or nitrides a metal film, a high-density plasma treatment in which a plasma density is greater than or equal to $1\times10^{11}$ $cm^{-3}$ or preferably in the range of $1\times10^{11}$ $cm^{-3}$ to $9\times10^{15}$ $cm^{-3}$ and which uses a high frequency wave such as a micro wave (for example, a frequency is 2.45 GHz) may be performed.

Note that the separation layer 702 in which a metal film and a metal oxide film are stacked may be formed by oxidizing a surface of the base metal film; however, a metal oxide film may be separately formed after a metal film has been formed. In a case of using tungsten as a metal, for example, a tungsten film is formed as the base metal film by a sputtering method, a CVD method, or the like, and then the tungsten film is subjected to plasma treatment. Accordingly, the tungsten film corresponding to the metal film and a metal oxide film which is in contact with the metal film and formed of an oxide of tungsten can be formed.

It is preferable that the semiconductor film 704 be consecutively formed after the formation of the insulating film 703 without exposure to air. The thickness of the semiconductor film 704 is 20 to 200 nm (preferably 40 to 170 nm, or more preferably 50 to 150 nm). The semiconductor film 704 may be an amorphous semiconductor or a polycrystalline semiconductor. Not only silicon but also silicon germanium can be used as the semiconductor. In the case of using silicon germanium, it is preferable that the concentration of germanium be approximately 0.01 to 4.5 atomic %.

Note that the semiconductor film 704 may be crystallized by a known technique. As the known technique of crystallization, a laser crystallization method using a laser beam and a crystallization method using a catalytic element are given. Alternatively, a crystallization method using a catalyst element and a laser crystallization method can be combined. In the case of using a thermally stable substrate such as quartz for the substrate 700, it is possible to combine any of the following crystallization methods as appropriate: a thermal crystallization method with an electrically heated oven, a lamp anneal crystallization method with infrared light, a crystallization method with a catalytic element, and high temperature annealing at about 950° C.

For example, in the case of using laser crystallization, thermal treatment at 550° C. is applied to the semiconductor film 704 for four hours before the laser crystallization, in order to enhance the resistance of the semiconductor film 704 to laser. By using a solid state laser capable of continuous oscillation and irradiating the semiconductor film 704 with laser light of a second to fourth harmonic of a fundamental wave, large grain crystals can be obtained. Typically, a second harmonic (532 nm) or a third harmonic (355 nm) of a $Nd:YVO_4$ laser (a fundamental wave of 1064 nm) is desirably used. Specifically, laser light emitted from a continuous-wave $YVO_4$ laser is converted into a harmonic by using a non-linear optical element, thereby obtaining laser light output of which is 10 W. Then, the laser light is preferably shaped into a rectangular shape or an elliptical shape with optics on the irradiation surface. The energy density of approximately 0.01 to 100 $MW/cm^2$ (preferably, 0.1 to 10 $MW/cm^2$) is required for the laser. In addition, the scan rate is set at approximately 10 to 2000 cm/sec.

Note that as a continuous oscillation gas laser, an Ar laser, a Kr laser, or the like can be used. As a continuous-wave solid-state laser, the following can be used: a YAG laser, a $YVO_4$ laser, a YLF laser, a $YAlO_3$ laser, a forsterite ($Mg_2SiO_4$) laser, a $GdVO_4$ laser, a $Y_2O_3$ laser, a glass laser, a ruby laser, an alexandrite laser, a Ti:sapphire laser, and the like.

As a pulse-oscillation laser, an Ar laser, a Kr laser, an excimer laser, a $CO_2$ laser, a YAG laser, a $Y_2O_3$ laser, a $YVO_4$ laser, a YLF laser, a $YAlO_3$ laser, a glass laser, a ruby laser, an alexandrite laser, a Ti:sapphire laser, a copper-vapor laser, or a gold-vapor laser can be used.

The repetition rate of pulsed laser light may be set at 10 MHz or higher, so that laser crystallization may be performed with a considerably higher frequency band than the normally used frequency band in the range of several ten to several hundred Hz. It is estimated that the time it takes for the semiconductor film 704 to completely solidify after being irradiated with pulsed oscillation laser light is several tens to several hundreds of nanoseconds. Therefore, by using the above frequency band, the semiconductor film 704 can be irradiated with a laser beam of the next pulse until the semiconductor film 704 is solidified after being melted by a laser beam of the preceding pulse. Accordingly, the solid-liquid interface in the semiconductor film 704 can be moved continuously and thus, the semiconductor film 704 having crystal grains that have grown in the scanning direction can be formed. Specifically, an aggregation of crystal grains each having a width of 10 to 30 μm in the scanning direction of the crystal grains and a width of approximately 1 to 5 μm in a direction perpendicular to the scanning direction can be formed. By forming single crystals with crystal grains that have continuously grown in the scanning direction, it is possible to form the semiconductor film 704 having few crystal grains at least in the channel direction of a TFT.

Note that the laser crystallization may be performed by irradiation with continuous wave laser light of a fundamental wave and continuous wave laser light of a harmonic in parallel or irradiation with continuous wave laser light of a fundamental wave and pulse-oscillation laser light of a harmonic in parallel.

Laser light irradiation may be performed in an inert gas atmosphere such as in a rare gas or nitrogen. By performing laser light irradiation in an inert gas atmosphere, roughness of a semiconductor surface caused by the laser light irradiation can be suppressed, and variation in a threshold voltage caused by variation in an interface state density can be suppressed.

By the above-described laser irradiation, the semiconductor film 704 with enhanced crystallinity can be formed. Note that it is also possible to use a polycrystalline semiconductor, which is formed by a sputtering method, a plasma CVD method, a thermal CVD method, or the like, for the semiconductor film 704.

The semiconductor film 704 is crystallized in this embodiment; however, an amorphous silicon film or a microcrystalline semiconductor film may be subjected to a process described below directly, without being crystallized. A TFT formed using an amorphous semiconductor or a microcrystalline semiconductor needs less fabrication steps than TFTs formed using a polycrystalline semiconductor. Therefore, it has an advantage of low cost and high yield.

An amorphous semiconductor can be obtained by glow discharge decomposition of a gas containing silicon. As examples of the gas containing silicon, $SiH_4$, $Si_2H_6$, and the like can be given. The gas containing silicon diluted with hydrogen or hydrogen and helium may be used.

Next, the semiconductor film 704 is subjected to channel doping, in which an impurity element which imparts p-type conductivity or an impurity element which imparts n-type conductivity is added at a low concentration. The channel doping may be performed to the whole semiconductor film 704 or part of the semiconductor film 704. As the impurity element which imparts p-type conductivity, boron (B), aluminum (Al), gallium (Ga), or the like can be used. As the impurity element imparting n-type conductivity, phosphorus (P), arsenic (As), or the like can be used. Here, boron (B) is used as the impurity element and added at a concentration of $1\times10^{16}$ to $5\times10^{17}/cm^3$.

Figure 11B:
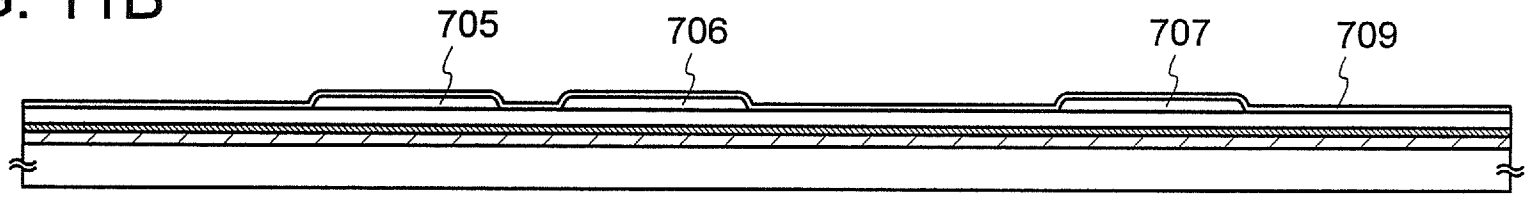

Next, as shown in FIG. 11B, the semiconductor film 704 is processed (patterned) into a predetermined shape to form island-shaped semiconductor films 705 to 707. Then, a gate insulating film 709 is formed so as to cover the island-shaped semiconductor films 705 to 707. The gate insulating film 709 can be formed as a single layer or stacked layer of a film containing silicon nitride, silicon oxide, silicon nitride oxide, or silicon oxynitride, by a plasma CVD method, a sputtering method, or the like. When the gate insulating film 709 is formed to have stacked layers, it is preferable to form a three-layer structure in which a silicon oxide film, a silicon nitride film, and a silicon oxide film are sequentially stacked over the substrate 700.

The gate insulating film 709 can also be formed by oxidizing or nitriding the surfaces of the island-shaped semiconductor films 705 to 707 by high-density plasma treatment. High-density plasma treatment is performed by using, for example, a mixed gas of a rare gas such as He, Ar, Kr, or Xe; and oxygen, nitrogen oxide, ammonia, nitrogen, or hydrogen. In this case, when excitation of a plasma is performed by introducing a microwave, a plasma with a low electron temperature and a high density can be generated. By an oxygen radical (there is a case where an OH radical is included) and/or a nitrogen radical (there is a case where an NH radical is included) generated by this high density plasma, the surface of the semiconductor film can be oxidized or nitrided whereby an insulating film with a thickness of 1 to 20 nm, typically 5 to 10 nm, may be formed so as to be in contact with the semiconductor film. The insulating film with a thickness of 5 to 10 nm is used as the gate insulating film 709.

Since oxidation or nitridation of the semiconductor film by the above-described high-density plasma treatment is progressed with solid reaction, interface state density between the gate insulating film and the semiconductor film can be extremely lowered. Moreover, by directly oxidizing or nitriding the semiconductor film by the high-density plasma treatment, variations in the thickness of the insulating film formed may be reduced. In the case where the semiconductor films have crystallinity, by oxidizing surfaces of the semiconductor films under a solid-phase reaction by the high-density plasma treatment, rapid oxidation can be prevented only in a crystal grain boundary; thus, a gate insulating film with good uniformity and low interface state density can be formed. When the insulating film formed by the high-density plasma treatment is included in part or all of a gate insulating film of transistors, variations in characteristics of the transistors can be suppressed.

Figure 11C:
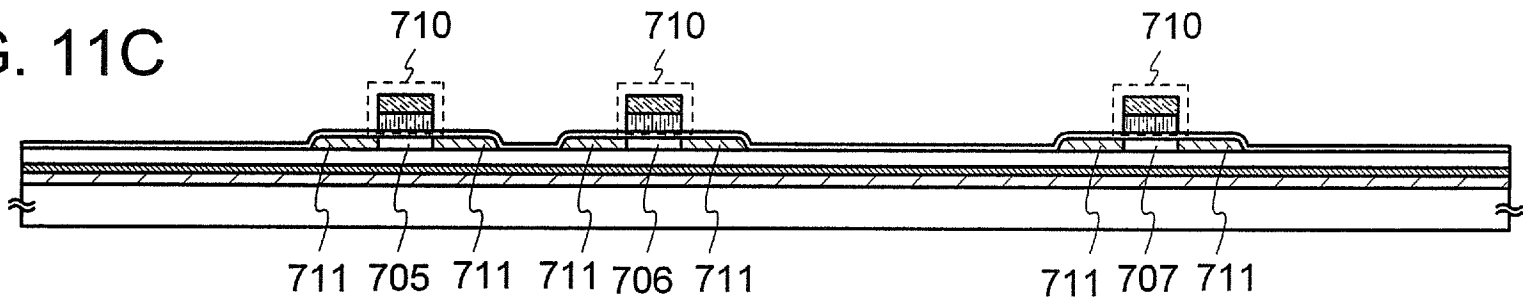

Next, as shown in FIG. 11C, a conductive film is formed over the gate insulating film 709, and the conductive film is patterned into predetermined shapes, so that electrodes 710 are formed above the island-shaped semiconductor films 705 to 707. In this embodiment, the electrodes 710 are each formed by patterning two stacked conductive films. As the conductive film, tantalum (Ta), tungsten (W), titanium (Ti), molybdenum (Mo), aluminum (Al), copper (Cu), chromium (Cr), niobium (Nb), or the like may be used. Alternatively, an alloy containing the above-described metal as a main component or a compound containing the above-described metal can also be used. Further alternatively, a semiconductor such as polycrystalline silicon, which is obtained by doping a semiconductor film with an impurity element that imparts conductivity such as phosphorus or the like, may be used.

In this embodiment, a tantalum nitride film or a tantalum film is used as a first conductive film and a tungsten film is used as a second conductive film. As a combination of these two conductive films, the following combinations are possible in addition to the example shown in this embodiment: a tungsten nitride film and a tungsten film; a molybdenum nitride film and a molybdenum film; an aluminum film and a tantalum film; an aluminum film and a titanium film, and the like. Tungsten and tantalum nitride have high heat resistance. Therefore, after the formation of the two conductive films, they may be heated for the purpose of thermal activation. In addition, as a combination of two conductive films, for example, nickel silicide and silicon doped with an impurity which imparts n-type conductivity, WSix and silicon doped with an impurity which imparts n-type conductivity, or the like can be used.

In this embodiment, the electrodes 710 are formed using two stacked conductive films; however, this embodiment is not limited to this structure. The electrodes 710 may be formed using a single conductive film or three or more stacked conductive films. In the case of a three-layer structure in which three or more conductive films are stacked, a stacked-layer structure of a molybdenum film, an aluminum film, and a molybdenum film is preferably employed.

The conductive films can be formed by a CVD method, a sputtering method, or the like. In this embodiment, the first conductive film is formed to a thickness of 20 to 100 nm, and the second conductive film is formed to a thickness of 100 to 400 nm.

Note that, as a mask used for the formation of the electrodes 710, a mask made of silicon oxide, silicon oxynitride, or the like may be used instead of the resist mask. In that case, a step of patterning the mask of silicon oxide, silicon oxynitride, or the like is added to the process; however, because less of the mask film is removed in an etching compared to how much of a resist is removed in an etching, the electrodes 710 can be formed with a desired width. Alternatively, the electrodes 710 may be selectively formed using a droplet discharging method, without using a mask.

Note that a droplet discharging method means a method in which droplets containing a predetermined composition are discharged or ejected from fine pores to form a predetermined pattern, and includes an ink-jet method and the like.

Next, the island-shaped semiconductor films 705 to 707 are doped with an impurity element which imparts n-type conductivity (typically, P (Phosphorus) or As (Arsenic)) with the electrodes 710 as masks, so that the island-shaped semiconductor films 705 to 707 contain the impurity element at a low concentration (a first doping step). The first doping step is performed under the following condition: a dose of $1\times10^{15}$ to $1\times10^{19}/cm^3$ and an accelerated voltage of 50 to 70 keV; however, this invention is not limited thereto. By this first doping step, doping is performed through the gate insulating film 709, so that low-concentration impurity regions 711 are formed in each of the island-shaped semiconductor films 705 to 707. Note that the first doping step may be performed with the island-shaped semiconductor film 706, which is to be a p-channel TFT, covered with a mask.

Figures 12A, 12B, 12C:
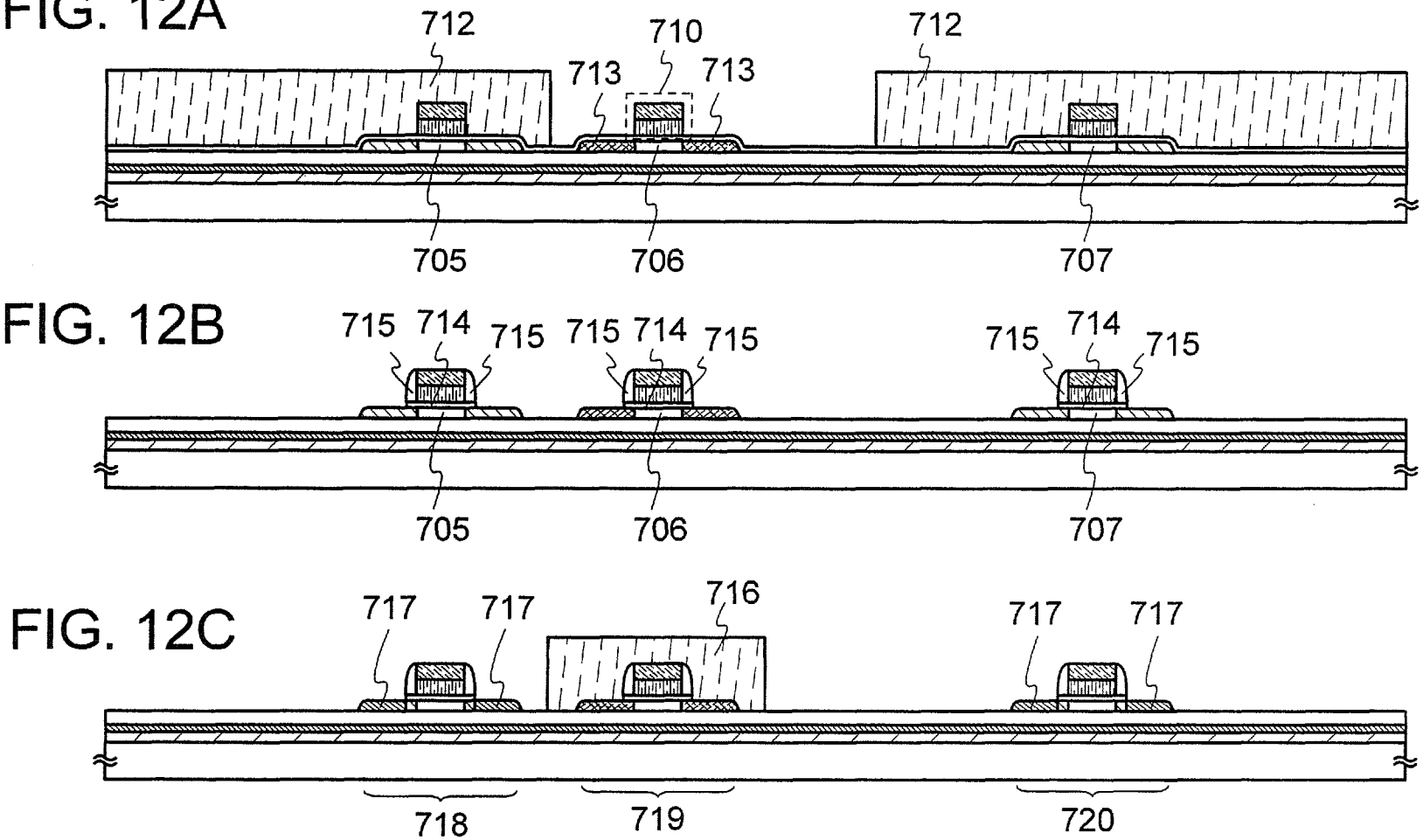
FIGS. 12A to 12C are diagrams illustrating a manufacturing method of a liquid crystal display device according to an aspect of this invention.

Next, as shown in FIG. 12A, a mask 712 is formed so as to cover the island-shaped semiconductor films 705 and 707 that are to be n-channel TFTs. Then, the island-shaped semiconductor film 706 is doped with an impurity element which imparts p-type conductivity (typically B (boron)) with the mask 712 and the electrode 710 as masks at a high concentration (a second doping step). The conditions of the second doping step are as follows: a dosage of $1\times10^{19}$ to $1\times10^{20}/cm^3$ and an acceleration voltage of 20 to 40 keV By this second doping step, doping is performed through the gate insulating film 709, so that p-type high-concentration impurity regions 713 are formed in the island-shaped semiconductor film 706.

Next, as shown in FIG. 12B, the mask 712 is removed by ashing or the like, and then an insulating film is formed so as to cover the gate insulating film 709 and the electrodes 710. The insulating film is formed by depositing a silicon film, a silicon oxide film, a silicon oxynitride film, a silicon nitride oxide film, or a film containing an organic material such as an organic resin, either in a single layer or stacked layers by a plasma CVD method, a sputtering method, or the like. In this embodiment, a silicon oxide film with a thickness of 100 nm is formed by a plasma CVD method.

Next, the insulating film and the gate insulating film 709 are partly etched by anisotropic etching mainly in the perpendicular direction. By this anisotropic etching, the gate insulating film 709 is partly etched to leave gate insulating films 714 that are partly formed over the island-shaped semiconductor films 705 to 707. Further, the insulating film formed so as to cover the gate insulating film 709 and the electrodes 710 is partly etched by the anisotropic etching, so that sidewalls 715 being in contact with the side surfaces of the electrodes 710 are formed. The sidewalls 715 are used as doping masks for formation of LDD (Lightly Doped Drain) regions. In this embodiment, a mixed gas of $CHF_3$ and He is used as an etching gas. Note that the process for forming the sidewalls 715 is not limited to this.

Next, as shown in FIG. 12C, a mask 716 is formed so as to cover the island-shaped semiconductor film 706 which is to be a p-channel TFT. Then, the island-shaped semiconductor films 705 and 707 are doped with an impurity element which imparts n-type conductivity (typically, P or As) by using the mask 716, the electrodes 710, and the sidewalls 715 as masks, so that the island-shaped semiconductor films 705 and 707 contain the impurity element at a high concentration (a third doping step). The third doping step is performed under the following condition: a dose of $1\times10^{19}$ to $1\times10^{20}/cm^3$ and an accelerated voltage of 60 to 100 keV. Through the third doping step, n-type high-concentration impurity regions 717 are formed in the island-shaped semiconductor films 705, 707, and 708.

Note that the sidewalls 715 function as masks later at the time of forming low concentration impurity regions or non-doped offset regions below the sidewalls 715 by doping the semiconductor film with an impurity which imparts n-type conductivity so that the semiconductor film contains the impurity element at a high concentration. Therefore, in order to control the width of the low-concentration impurity regions or the offset regions, conditions of the anisotropic etching at the time of forming the sidewalls 715 or the thickness of the insulating film for forming the sidewalls 715 may be changed as appropriate so that the size of the sidewalls 715 is adjusted.

Note that low-concentration impurity regions or non-doped offset regions may be formed in the semiconductor film 706 under the sidewalls 715.

Next, the mask 716 is removed by ashing or the like, and then the impurity regions may be activated by heat treatment. For example, after a silicon oxynitride film with a thickness of 50 nm is formed, heat treatment may be performed at 550° C. for 4 hours in a nitrogen atmosphere.

Alternatively, a silicon nitride film containing hydrogen may be formed first to a thickness of 100 nm, followed by thermal treatment at 410° C. in a nitrogen atmosphere for one hour so that the island-shaped semiconductor films 705 to 707 are hydrogenated. As a further alternative, the island-shaped semiconductor films 705 to 707 may be subjected to thermal treatment at 300 to 450° C. in an atmosphere containing hydrogen for 1 to 12 hours so as to be hydrogenated. The thermal treatment can be performed by a thermal annealing method, a laser annealing method, an RTA method, or the like. By the heat treatment, the impurity element added to the semiconductor films can be activated as well as hydrogenation. As another means for the hydrogenation, plasma hydrogenation (using hydrogen that is excited by plasma) may be performed. In the hydrogenation process, a dangling bond can be terminated by using the thermally excited hydrogen.

Through the above series of steps, n-channel TFTs 718 and 720 and the p-channel TFT 719 are formed.

Figures 13A, 13B, 13C:
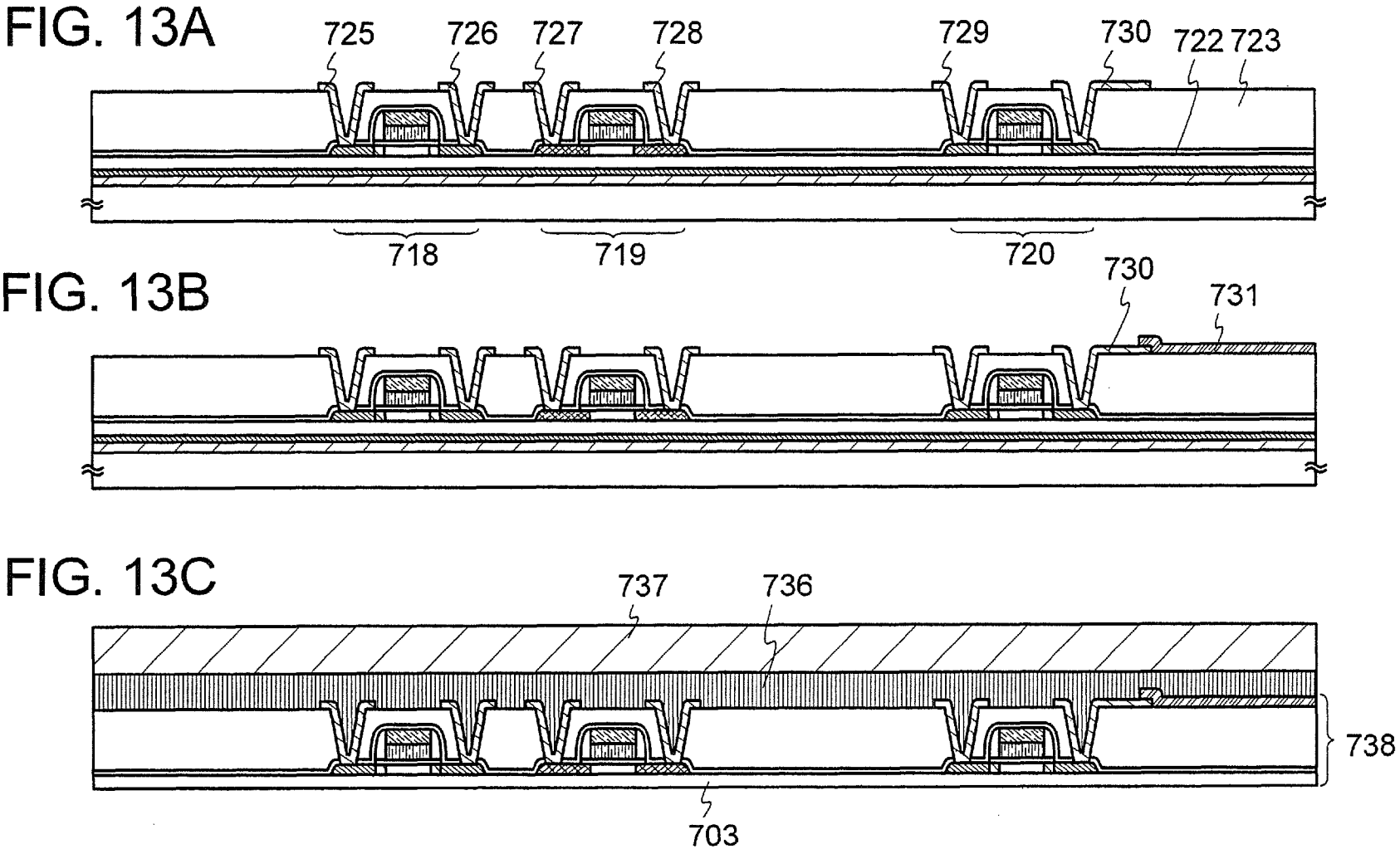
FIGS. 13A to 13C are diagrams illustrating a manufacturing method of a liquid crystal display device according to an aspect of this invention.

Next, as shown in FIG. 13A, an insulating film 722 is formed so as to cover the TFTs 718 to 720. Although the insulating film 722 is not always necessary, by forming the insulating film 722, impurities such as alkali metal and alkaline earth metal are prevented from entering the TFTs 718 to 720. Specifically, it is preferable to use silicon nitride, silicon nitride oxide, aluminum nitride, aluminum oxide, silicon oxide, or the like as the insulating film 722. In this embodiment, a silicon oxynitride film with a thickness of about 600 nm is used as the insulating film 722. In this case, a hydrogenation step may be performed after the formation of this silicon oxynitride film.

Next, an insulating film 723 is formed over the insulating film 722 so as to cover the TFTs 718 to 720. An organic material having heat resistance, such as polyimide, acrylic, benzocyclobutene, polyamide, or epoxy can be used for the insulating film 723. Alternatively, a low-dielectric constant material (Low-k material), a siloxane-based resin, silicon oxide, silicon nitride, silicon oxynitride, silicon nitride oxide, PSG (phosphosilicate glass), BPSG (borophosphosilicate glass), alumina, or the like can be used besides the above organic materials. A siloxane-based resin may contain as a substituent at least one of fluorine, an alkyl group, and aromatic hydrocarbon, in addition to hydrogen. Note that the insulating film 723 may be formed in such a manner that a plurality of insulating films formed of any of the above-described materials is stacked.

The insulating film 723 can be formed by a CVD method, a sputtering method, an SOG method, spin coating, dipping, spray coating, a droplet discharge method (an ink-jet method, screen printing, offset printing, or the like), a doctor knife, a roll coater, a curtain coater, a knife coater, or the like depending on a material of the insulating film 723.

Next, contact holes are formed in the insulating film 722 and the insulating film 723 such that each of the island-shaped semiconductor films 705 to 707 is partly exposed. Then, conductive films 725 to 730 which are in contact with the island-shaped semiconductor films 705 to 707 through the contact holes are formed. As a gas for etching to form the contact holes, a mixed gas of $CHF_3$ and He is used; however, this invention is not limited thereto.

The conductive films 725 to 730 may be formed by a CVD method, a sputtering method, or the like. Specifically, the conductive films 725 to 730 can be formed using aluminum (Al), tungsten (W), titanium (Ti), tantalum (Ta), molybdenum (Mo), nickel (Ni), platinum (Pt), copper (Cu), gold (Au), silver (Ag), manganese (Mn), neodymium (Nd), carbon (C), silicon (Si), or the like. Alternatively, an alloy containing the above-described metal as a main component or a compound containing the above-described metal can also be used. The conductive films 725 to 730 can be either a single layer of the above-described metal film or a plurality of stacked layers thereof.

As an example of an alloy containing aluminum as a main component, an alloy which contains aluminum as a main component and nickel can be given. Further, an alloy which contains aluminum as a main component and contains nickel and one or both of carbon and silicon can also be given. Aluminum and aluminum silicon, which have a low resistance value and are inexpensive, are the most suitable materials for formation of the conductive films 725 to 730. In particular, when an aluminum silicon film is used, generation of hillocks in resist baking can be suppressed more than the case of using an aluminum film, in patterning the conductive films 725 to 730. Further, instead of silicon, copper (Cu) may be mixed into an aluminum film at about 0.5 wt. %.

Each of the conductive films 725 to 730 may be formed to have a stacked structure of, for example, a barrier film, an aluminum silicon film, and a barrier film, or a stacked structure of a barrier film, an aluminum silicon film, a titanium nitride film, and a barrier film. Note that a barrier film is a film formed using titanium, a nitride of titanium, molybdenum, or a nitride of molybdenum. When barrier films are formed to sandwich an aluminum silicon film therebetween, generation of hillocks of aluminum or aluminum silicon can be prevented more effectively. Further, when a barrier film is formed using titanium, which is a highly reducible element, even if a thin oxide film is formed over the island-shaped semiconductor films 705 to 707, the oxide film is reduced by titanium contained in the barrier film so that good contact between the conductive films 725 to 730 and the island-shaped semiconductor films 705 to 707 can be obtained. Alternatively, a plurality of barrier films may be stacked to be used. In that case, the conductive films 725 to 730 can each have a five-layer structure in which titanium, titanium nitride, aluminum silicon, titanium, and titanium nitride are sequentially stacked from the bottom.

Note that the conductive films 725 and 726 are connected to the high-concentration impurity regions 717 of the n-channel TFT 718. The conductive films 727 and 728 are connected to the high-concentration impurity regions 713 of the p-channel TFT 719. The conductive films 729 and 730 are connected to the high-concentration impurity regions 717 of the n-channel TFT 720.

Next, as shown in FIG. 13B, an electrode 731 is formed over the insulating film 723 so as to be in contact with the conductive film 730. FIG. 13B shows an example of manufacturing a transmissive liquid crystal element by forming the electrode 731 using a conductive film which easily transmits light; however, this invention is not limited to this structure. A liquid crystal display device of this invention may be a transflective type.

A transparent conductive film used as the electrode 731 can be formed of indium tin oxide containing silicon oxide (ITSO), indium tin oxide (ITO), zinc oxide (ZnO), indium zinc oxide (IZO), gallium-doped zinc oxide (GZO), or the like.

As shown in FIG. 13C, a protective layer 736 is formed over the insulating film 723 so as to cover the conductive films 725 to 730 and the electrodes 731. The protective layer 736 is formed of a material by which the insulating film 723, the conductive films 725 to 730, and the electrodes 731 can be protected at the time of separating the substrate 700 with the separation layer 702 used as a boundary later. For example, the protective layer 736 can be formed by applying an epoxy-based, acrylate-based, or silicone-based resin that is soluble in water or alcohols over the entire surface.

In this embodiment, the protective layer 736 is formed in the following manner: a water-soluble resin (manufactured by Toagosei Co., Ltd.: VL-WSHL10) is applied to a thickness of 30 μm by a spin coating method and exposed to light for 2 minutes so that it is temporarily cured. Then, the resin is exposed to UV light for a total of 12.5 minutes, including 2.5 minutes of light exposure from a back surface and 10 minutes of light exposure from a front surface, to fully cure the resin. Note that in the case of stacking a plurality of organic resins, depending on a solvent used, the stacked organic resins might be partly melted or adhesiveness might become too strong during application or baking. Therefore, in the case where organic resins that are soluble in the same solvent are used for the insulating film 723 and the protective layer 736, it is preferable to form an inorganic insulating film (e.g., a silicon nitride film, a silicon nitride oxide film, an $AlN_x$ film, or an $AlN_xO_y$ film) so as to cover the insulating film 723 in order that the protective layer 736 can be smoothly removed in a later step.

Next, as shown in FIG. 13C, a layer of from the insulating film 703 up to the conductive films 725 to 730 formed over the insulating film 723, which includes semiconductor elements typified by TFTs and various conductive films, (hereinafter referred to as an "element formation layer 738"), and the protective layer 736 are separated from the substrate 700. In this embodiment, a first sheet material 737 is attached to the protective layer 736, and the element formation layer 738 and the protective layer 736 are separated from the substrate 700 by physical force. The separation layer 702 does not need to be completely removed and may be partly left.

As the above-described separation step, a method of etching the separation layer 702 may be performed. In this case, a groove is formed so as to partly expose the separation layer 702. The groove is formed by dicing, scribing, processing using laser light including UV light, a photolithography method, or the like. It is only necessary that the groove be deep enough to expose the separation layer 702. A halogen fluoride is used as an etching gas, and the gas is introduced through the groove. In this embodiment, for example, $ClF_3$ (chlorine trifluoride) is used for etching in accordance with the following condition: a temperature of 350° C., a flow rate of 300 sccm, a pressure of 800 Pa, and a processing time of 3 hours. In addition, nitrogen may be mixed into the $ClF_3$ gas. Using halogen fluoride such as $ClF_3$ enables the separation layer 702 to be etched as selected, so that the substrate 700 can be separated from the element formation layer 738. Further, the halogen fluoride may be either a gas or a liquid.

Figure 14A:
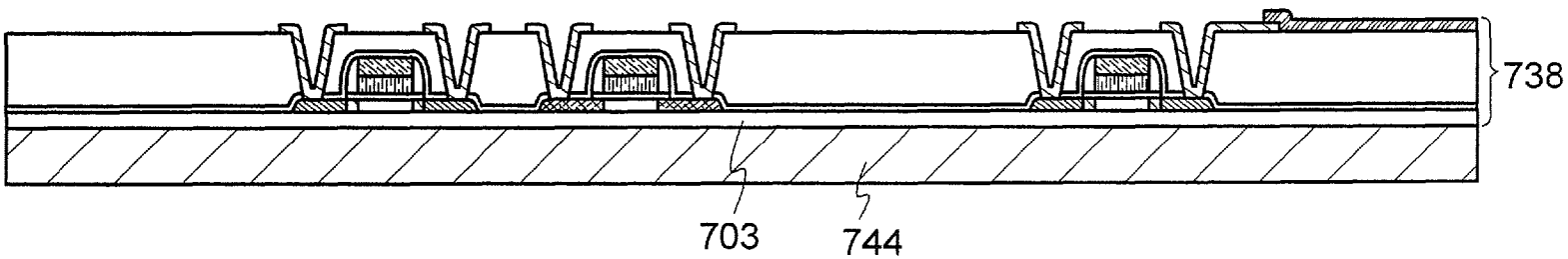
FIGS. 14A and 14B are diagrams illustrating a manufacturing method of a liquid crystal display device according to an aspect of this invention.

Next, as shown in FIG. 14A, a second sheet material 744 is attached to a surface which is exposed by the separation of the element formation layer 738. Then, after the element formation layer 738 and the protective layer 736 are separated from the first sheet material 737, the protective layer 736 is removed.

As the second sheet material 744, for example, a glass substrate such as barium borosilicate glass, or aluminoborosilicate glass, a flexible organic material such as paper or plastic can be used. Alternatively, as the second sheet material 744, a flexible inorganic material can be used. The plastic substrate may be made of ARTON including poly-norbornene that has a polar group (manufactured by JSR). In addition, polyester typified by polyethylene terephthalate (PET); polyether sulfone (PES); polyethylene naphthalate (PEN); polycarbonate (PC); polyether etherketone (PEEK); polysulfone (PSF); polyether imide (PEI); polyarylate (PAR); polybutylene terephthalate (PBT); polyimide; an acrylonitrile butadiene styrene resin; poly vinyl chloride; polypropylene; poly vinyl acetate; an acrylic resin; and the like can be given.

Note that in the case where semiconductor elements corresponding to a plurality of liquid crystal display devices are formed over the substrate 700, the element formation layer 738 is cut into individual liquid crystal display devices. Cutting can be performed with a laser irradiation apparatus, a dicing apparatus, a scribing apparatus, or the like.

Figure 14B:
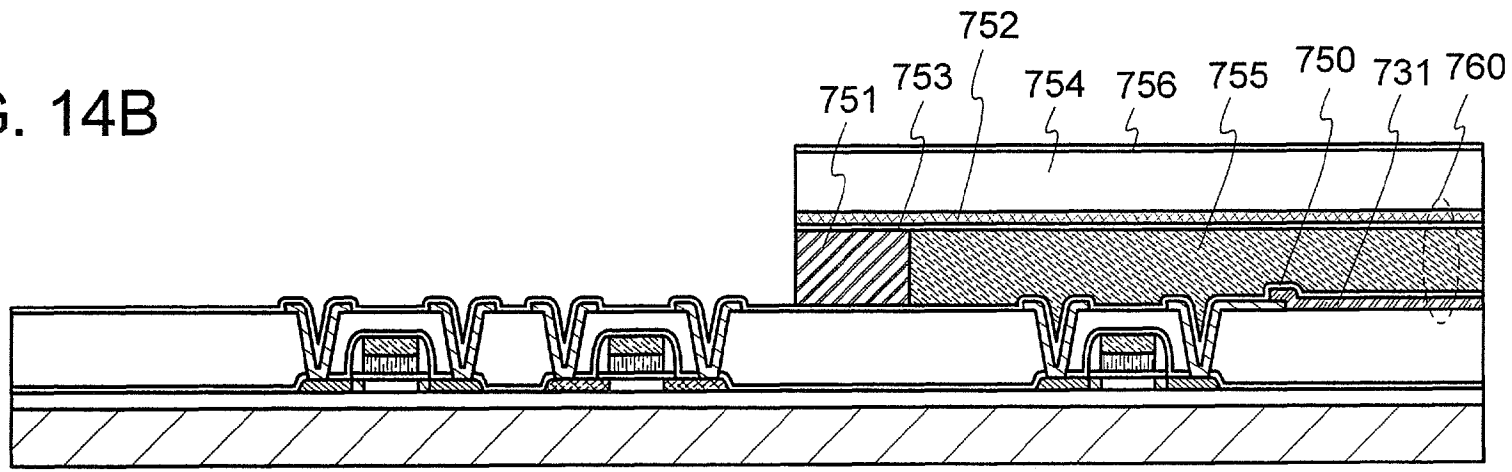

Next, as shown in FIG. 14B, an alignment film 750 is formed so as to cover the conductive film 730 and the electrode 731, and rubbing treatment is performed. The alignment film 750 is selectively formed by patterning or the like in a region which is to serve as a liquid crystal display device. Then, a sealant 751 for sealing the liquid crystal is formed. On the other hand, a substrate 754 on which an electrode 752 using a transparent conductive film and an alignment film 753 to which rubbing treatment is performed is prepared. Then, liquid crystal 755 is dropped in the region surrounded by the sealant 751, and the substrate 754 which is prepared separately is attached using the sealant 751 so that the electrode 752 and the electrode 731 are faced. Note that filler may be mixed in the sealant 751.

Note that a color filter and a shielding film (black matrix) for preventing disclination may be formed. In addition, a polarizing plate 756 is attached to the opposite face of the substrate 754 on which the electrode 752 is formed.

A transparent conductive film used as the electrode 731 or the electrode 752 can be formed of indium tin oxide containing silicon oxide (ITSO), indium tin oxide (ITO), zinc oxide (ZnO), indium zinc oxide (IZO), gallium-doped zinc oxide (GZO), or the like. A liquid crystal element 760 is formed by stacking the electrode 731, the liquid crystal 755, and the electrode 752.

A dispenser method (dripping method) is used for the foregoing injection of the liquid crystal; however, this invention is not limited to the method. Dipping method (pumping method) in which liquid crystal is injected after the substrate 754 is attached may be used.

Note that this embodiment shows an example in which the element formation layer 738 is used by being separated from the substrate 700; however, the foregoing element formation layer 738 is formed over the substrate 700 without providing the separation layer 702, and may be used as a liquid crystal display device.

Further, in this embodiment, the thicknesses of the gate insulating films 714 are the same in all the TFTs, that is, the TFTs 718, 719, and 720; however, this invention is not limited to this structure. For example, the thickness of the gate insulating film included in the TFT in a circuit which is required to drive at higher speed may be thinner than that of the other circuits.

Further, although description is made with reference to an example of a thin film transistor in this embodiment, this invention is not limited to this structure. Other than a thin film transistor, a transistor formed using single-crystal silicon, a transistor formed using an SOI, or the like can be used as well.

This embodiment can be implemented by being combined as appropriate with any of the above-described embodiment modes.

Embodiment 2

Figure 15A:
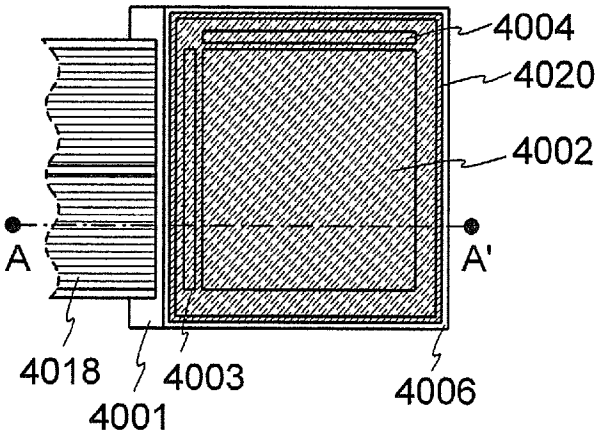
FIG. 15A is a top view of a liquid crystal display device according to an aspect of this invention.
Figure 15B:
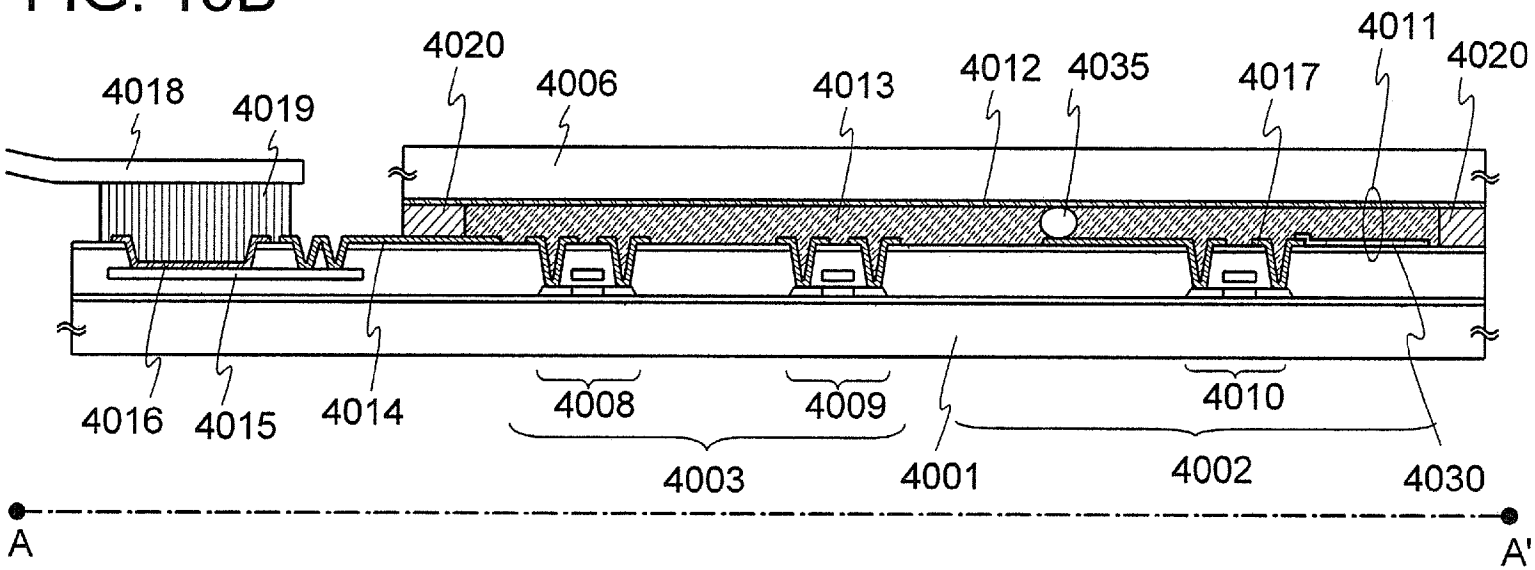
FIG. 15B is a cross-sectional view of the liquid crystal display device according to an aspect of this invention.

In this embodiment, the appearance of a liquid crystal display device of this invention will be described with reference to FIGS. 15A and 15B. FIG. 15A is a top view of a panel in which a transistor and a liquid crystal element formed over a first substrate are formed between the first substrate and a second substrate. FIG. 15B is a cross-sectional view of the FIG. 15A along line A-A'.

A sealant 4020 is formed so as to surround a pixel portion 4002, a signal line driver circuit 4003, and a scanning line driver circuit 4004, which are formed over a first substrate 4001. In addition, a second substrate 4006 is formed over the pixel portion 4002, the signal line driver circuit 4003, and the scanning line driver circuit 4004. Thus, the pixel portion 4002, the signal line driver circuit 4003, and the scanning line driver circuit 4004 are tightly sealed between the first substrate 4001 and the second substrate 4006 with the sealant 4020.

Each of the pixel portion 4002, the signal line driver circuit 4003, and the scanning line driver circuit 4004, which are formed over the first substrate 4001 has a plurality of transistors. In FIG. 15B, a transistor 4008 and a transistor 4008 included in the signal line driver circuit 4003, and a transistor 4010 included in the pixel portion 4002 are illustrated.

In addition, a liquid crystal element 4011 includes a pixel electrode 4030 connected to a source region or a drain region of the transistor 4010 via a wiring 4017, a counter electrode 4012 formed on the second substrate 4006, and the liquid crystal 4013.

Note that although it is not illustrated, the liquid crystal display device shown in this embodiment includes an alignment film, a polarizing plate, and further, may include a color filter and a shielding film.

In addition, reference numeral 4035 is a spherical spacer which is provided to control the distance (a cell gap) between the pixel electrode 4030 and the counter electrode 4012. In addition, a spacer which is obtained by patterning an insulating film may be used.

Various kinds of voltages and signals applied to the signal line driver circuit 4003, the scanning line driver circuit 4004 or the pixel portion 4002 are supplied from a connection terminal 4016 via wirings 4014 and 4015. The connection terminal 4016 is electrically connected to a terminal of an FPC 4018 via an anisotropic conductive film 4019.

This embodiment can be combined with the above embodiment modes and the above embodiment, as appropriate.

Embodiment 3

In this embodiment, the arrangement of a liquid crystal panel and a light source in a liquid crystal display device of this invention will be described.

Figure 16:
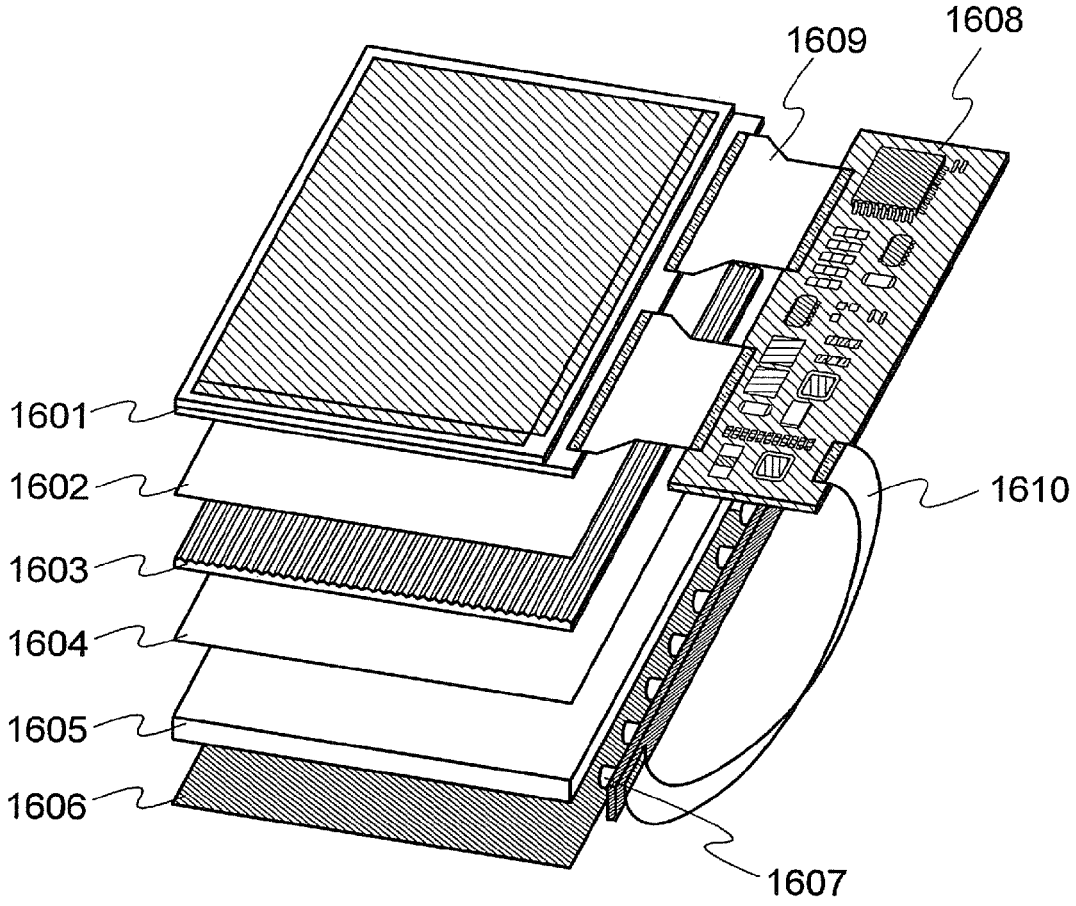
FIG. 16 is a perspective view illustrating a structure of a liquid crystal display device according to an aspect of this invention.

FIG. 16 is one example of a perspective view showing the structure of a liquid crystal display device of this invention. The liquid crystal display device shown in FIG. 16 includes a liquid crystal panel 1601 in which a liquid crystal element is formed between a pair of substrates, a first diffusing plate 1602, a prism sheet 1603, a second diffusing plate 1604, a light guide plate 1605, a reflector 1606, a light source 1607, and a circuit board 1608.

The liquid crystal panel 1601, the first diffusing plate 1602, the prism sheet 1603, the second diffusing plate 1604, the light guide plate 1605, and the reflector 1606 are stacked sequentially. The light source 1607 is provided on an edge portion of the light guide plate 1605; and light from the light source 1607, which is diffused into the inside of the light guide plate 1605, is evenly delivered to the liquid crystal panel 1601 by the prism sheet 1603 and the second diffusing plate 1604.

Note that although the first diffusing plate 1602 and the second diffusing plate 1604 are used in this embodiment, the number of diffusing plates is not limited to this and may be single, three, or more. In addition, the diffusing plate may be provided between the light guide plate 1605 and the liquid crystal panel 1601. Thus, the diffuser may be provided only on a side closer to the liquid crystal panel 1601 from the prism sheet 1603, or only a side closer to the light guide plate 1605 from the prism sheet 1603.

In addition, the form of the prism sheet 1603 in cross section is not limited to a sawtooth form shown in FIG. 16 and may have a form that can condense light from the light guide plate 1605 on the liquid crystal panel 1601 side.

A circuit that generates various signals to be input to the liquid crystal panel 1601, a circuit that processes these signals, and the like are formed over the circuit board 1608. In FIG. 16, the circuit board 1608 and the liquid crystal panel 1601 are connected to each other through an FPC (flexible printed circuit) 1609. Note that the above-described circuits may be connected to the liquid crystal panel 1601 by a COG (chip on glass) method, or part of the circuits may be connected to the liquid crystal panel 1601 by a COF (chip on film) method.

FIG. 16 shows an example in which circuits of a control system, such as a comparing circuit and a control circuit which control the driving of the light source, 1607 are provided over the circuit board 1608, and the circuits of the control system and the light source 1607 are connected to each other through the FPC 1610. Note that the above-described circuits of the control system may be formed over the liquid crystal panel 1601. In that case, the liquid crystal panel 1601 and the light source 1607 are connected to each other through an FPC or the like.

Note that although FIG. 16 illustrates an edge-light type light source where the light source 1607 is provided on the edge of the liquid crystal panel 1601, a direct type light source where the light sources 1607 are provided directly below the liquid crystal panel 1601 may be used.

This embodiment can be combined with the above embodiment modes and the above embodiment, as appropriate.

Embodiment 4

As electronic devices that can use a liquid crystal display device of this invention, the following can be given: a mobile phone, a portable game machine, an e-book reader, a video camera, a digital still camera, a goggle display (a head mounted display), a navigation system, an audio reproducing device (e.g., a car audio or an audio component set), a laptop computer, an image reproducing the content of device provided with a recording medium (typically a device for reproducing a recording medium such as a digital versatile disc (DVD) and having a display for displaying the reproduced image), and the like. Specific examples of these electronic devices are shown in FIGS. 17A to 17C.

Figure 17A:
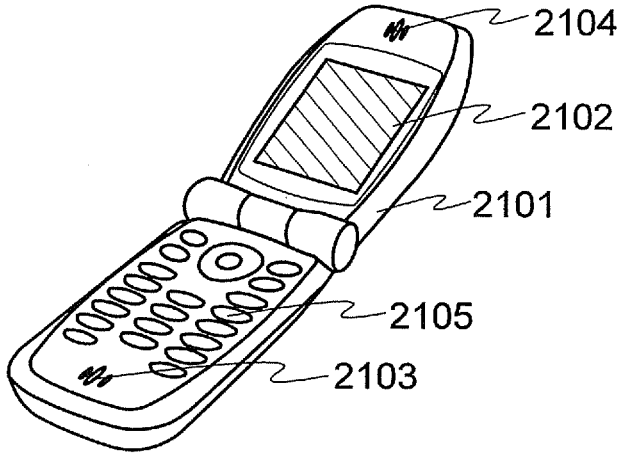
FIGS. 17A to 17C each illustrates an electronic device using a liquid crystal display device according to an aspect of this invention.

FIG. 17A shows a mobile phone, which includes a main body 2101, a display portion 2102, an audio input portion 2103, an audio output portion 2104, and operation keys 2015. When the liquid crystal display device of this invention is used for the display portion 2102, a mobile phone which is capable of preventing moving images from appearing blurred can be obtained.

Figure 17B:
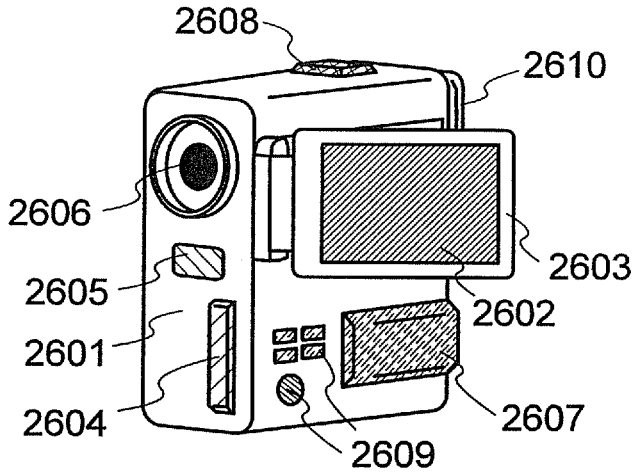

FIG. 17B shows a video camera, which includes a main body 2601, a display portion 2602, a housing 2603, an external connection port 2604, a remote control receiving portion 2605, an image receiving portion 2606, a battery 2607, an audio input portion 2608, operation keys 2609, an eyepiece portion 2610, and the like. When the liquid crystal display device of this invention is used for the display portion 2602, a video camera which is capable of preventing moving images from appearing blurred can be obtained.

Figure 17C:
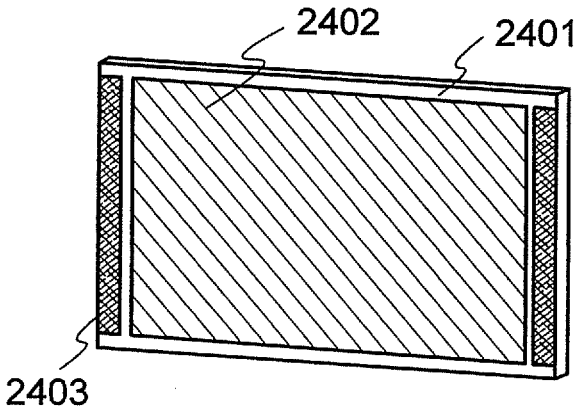

FIG. 17C is an image display unit which includes a housing 2401, a display portion 2402, a speaker portion 2403, and the like. When the liquid crystal display device of this invention is used for the display portion 2402, an image display unit which is capable of preventing moving images from appearing blurred can be obtained. Note that the image display unit includes all devices for displaying image such as for a personal computer, for receiving TV broadcasting, and for displaying an advertisement.

As described above, an application range of this invention is extremely wide and this invention can be applied to electronic devices in various fields.

This embodiment can be implemented in combination with any of the above-described embodiment modes or the above-described embodiments as appropriate.

This application is based on Japanese Patent Application serial no. 2007-295011 filed with Japan Patent Office on Nov. 14, 2007, the entire contents of which are hereby incorporated by reference.

EXPLANATION OF REFERENCE

100 pixel, 101 comparing circuit, 102 control circuit, 103 light source, 104 liquid crystal element, 105 switching element, 106 capacitor element.

200 pixel, 201 comparing circuit, 202 control circuit, 203 light source, 204 liquid crystal element, 205 switching element, 206 capacitor element, 207 capacitor element.

300 pixel, 300*a* monitoring pixel, 301 pixel portion, 302 comparing circuit, 303 control circuit, 304 light source, 305 transistor, 306 liquid crystal element, 307 capacitor element.

401-403 period.

501 comparing circuit, 502 control circuit, 503 light source, 504 memory circuit, 505 switching circuit, 506 buffer.

600 pixel portion, 610 scanning line driver circuit, 620 signal line driver circuit, 621 shift register, 622 memory circuit, 623 memory circuit, 624 DA converter, 630 comparing circuit, 631 control circuit, 632 light source, 633 monitoring pixel, 640 pixel portion, 650 scanning line driver circuit, 660 signal line driver circuit, 661 shift register, 662 sampling circuit, 663 memory circuit, 670 comparing circuit, 671 control circuit, 672 light source, 673 monitoring pixel.

801 light source, 802 comparing circuit, 803 control circuit, 804 light detector, 805 signal generating circuit, 806 luminance control circuit, 807 integrating circuit, 808 luminance comparing circuit, 810 switching element, 811 resistor element, 820-821 light source, 823 control circuit, 824 image processing filter, 825 signal processing circuit, 826 first luminance control circuit, 827 second luminance control circuit, 840-843 region, 844-847 light source, 8221-8222 comparing circuit.

900 pixel portion, 910 scanning line driver circuit, 920 signal line driver circuit, 921 shift register, 922-923 memory circuit, 930 comparing circuit, 931 control circuit, 932 light source, 933 monitoring pixel.

The invention claimed is:

1. A liquid crystal display device comprising:

a liquid crystal element including a pixel electrode, a switching element, a counter electrode, and a liquid crystal disposed between the pixel electrode and the counter electrode;

a signal line; and a light source;

wherein one terminal of the switching element is connected with the signal line and another terminal of the switching element is connected with the pixel electrode, and wherein the light source is turned on and turned off by detecting a change of relative permittivity of the liquid crystal disposed between the pixel electrode and the counter electrode while the switching element is off.

2. The liquid crystal display device according to claim 1, further comprising a capacitor element electrically connected to the liquid crystal element.

3. The liquid crystal display device according to claim 1, further comprising a first capacitor element and a second capacitor element which are electrically connected to the liquid crystal element.

4. The liquid crystal display device according to claim 1, wherein the light source includes a light emitting diode.

5. The liquid crystal display device according to claim 1, further comprising a control circuit including a memory circuit and a switching circuit configured for turning-on and turning-off of the light source.

6. The liquid crystal display device according to claim 1, further comprising:

a light detector configured to detect luminance or intensity of light in an environment where the liquid crystal display device is used, and to generate a first signal;

a signal generating circuit configured to generate a second signal in accordance with an output of the light detector; and a luminance control circuit configured to adjust the luminance of the light source in accordance with the second signal.

7. The liquid crystal display device according to claim 1, further comprising:

a light detector configured to detect luminance or intensity of light in an environment where the liquid crystal display device is used, and to generate a first signal;

a signal generating circuit configured to generate a second signal in accordance with an output of the light detector; and a luminance control circuit configured to adjust the luminance of the light source in accordance with the second signal, wherein the signal generating circuit generates the second signal for adjusting the luminance of the light source so as to make the luminance of the light source higher as the luminance or the intensity of light in the environment becomes higher, or to make the luminance of the light source lower as the luminance or the intensity of light in the environment becomes lower.

8. The liquid crystal display device according to claim 1, wherein the change of the relative permittivity of the liquid crystal disposed between the pixel electrode and the counter electrode is detected by comparing a reference potential and a potential of the pixel electrode when the switching element is off.

9. The liquid crystal display device according to claim 8, wherein the reference potential is set at a fixed value determined by the liquid crystal.

10. A liquid crystal display device comprising:

a counter electrode;

a first liquid crystal element and a second liquid crystal element, each including a pixel electrode, and a switching element;

a liquid crystal disposed between the pixel electrodes of the first liquid crystal element and the second liquid crystal element and the counter electrode;

a first signal line and a second signal line; and a first light source and a second light source;

wherein one terminal of the switching element of the first liquid crystal element is connected with the first signal line and another terminal of the switching element of the first liquid crystal element is connected with the pixel electrode of the first liquid crystal element, wherein one terminal of the switching element of the second liquid crystal element is connected with the second signal line and another terminal of the switching element of the second liquid crystal element is connected with the pixel electrode of the second liquid crystal element, and wherein the first light source and the second light source are turned on and turned off by detecting a change of relative permittivity of the liquid crystal disposed between the pixel electrode of the first liquid crystal element and the counter electrode while the switching element of the first liquid crystal element is off, and a change of relative permittivity of the liquid crystal disposed between the pixel electrode of the second liquid crystal element and the counter electrode while the switching element of the second liquid crystal element is off, respectively.

11. The liquid crystal display device according to claim 10, further comprising a first capacitor element electrically connected to the first liquid crystal element and a second capacitor element electrically connected to the second liquid crystal element.

12. The liquid crystal display device according to claim 10, further comprising a first capacitor element and a second capacitor element which are electrically connected to the first liquid crystal element, and a third capacitor element and a fourth capacitor element which are electrically connected to the second liquid crystal element.

13. The liquid crystal display device according to claim 10, wherein each of the first light source and the second light source includes a light emitting diode.

14. The liquid crystal display device according to claim 10, further comprising a control circuit including a memory circuit and a switching circuit configured for turning-on and turning-off of each of the first light source and the second light source.

15. The liquid crystal display device according to claim 10, further comprising:

a light detector configured to detect luminance or intensity of light in an environment where the liquid crystal display device is used, and to generate a first signal;

a signal generating circuit configured to generate a second signal in accordance with an output of the light detector; and a luminance control circuit configured to adjust the luminance of each of the first light source and the second light source in accordance with the second signal.

16. The liquid crystal display device according to claim 10, further comprising:

a light detector configured to detect luminance or intensity of light in an environment where the liquid crystal display device is used, and to generate a first signal;

a signal generating circuit configured to generate a second signal in accordance with an output of the light detector; and a luminance control circuit configured to adjust the luminance of each of the first light source and the second light source in accordance with the second signal, wherein the signal generating circuit generates the second signal for adjusting the luminance of each of the first light source and the second light source so as to make the luminance of each of the first light source and the second light source higher as the luminance or the intensity of light in the environment becomes higher, or to make the luminance of each of the first light source and the second light source lower as the luminance or the intensity of light in the environment becomes lower.

17. The liquid crystal display device according to claim 10, further comprising:

an image processing filter configured to calculate an averaged gray level of a first video signal to be input to the first liquid crystal element, and to calculate an averaged gray level of a second video signal to be input to the second liquid crystal element;

a signal processing circuit configured to generate a second signal in accordance with the average gray level of each of the first video signal and the second video signal, and a luminance control circuit configured to adjust a luminance of each of the first light source and the second light source in accordance with the second signal.

18. The liquid crystal display device according to claim 10, further comprising:

an image processing filter configured to calculate an averaged gray level of a first video signal to be input to the first liquid crystal element, and to calculate an averaged gray level of a second video signal to be input to the second liquid crystal element;

a signal processing circuit configured to generate a second signal in accordance with the average gray level of each of the first video signal and the second video signal, and a luminance control circuit configured to adjust a luminance of each of the first light source and the second light source in accordance with the second signal, wherein the signal processing circuit generates the second signal for making the luminance of the first light source higher than the luminance of the second light source when the averaged gray level of the first video signal is higher than the averaged gray level of the second video signal, and for making the luminance of the first light source lower than the luminance of the second light source when the averaged gray level of the first video signal is lower than the averaged gray level of the second video signal.

19. The liquid crystal display device according to claim 10, wherein the change of the relative permittivity of the liquid crystal disposed between the pixel electrode of the first liquid crystal element and the counter electrode is detected by comparing a reference potential and a potential of the pixel electrode of the first liquid crystal element and the change of the relative permittivity of the liquid crystal disposed between the pixel electrode of the second liquid crystal element and the counter electrode is detected by comparing a reference potential and a potential of the pixel electrode of the second liquid crystal element.

20. The liquid crystal display device according to claim 19, wherein the reference potential is set at a fixed value determined by the liquid crystal.

* * * * *